US008128537B2

(12) United States Patent
Signorile et al.

(10) Patent No.: US 8,128,537 B2
(45) Date of Patent: Mar. 6, 2012

(54) VIBRATORY EXERCISE DEVICE WITH LOW CENTER OF GRAVITY AND MODULAR WEIGHTS

(75) Inventors: Joseph F. Signorile, Miami, FL (US); Samuel S. Hollander, Coral Gables, FL (US)

(73) Assignee: Concept One International LLC, Coral Gables, FL (US)

( * ) Notice: Subject to any disclaimer, the term of this patent is extended or adjusted under 35 U.S.C. 154(b) by 44 days.

(21) Appl. No.: 12/616,548

(22) Filed: Nov. 11, 2009

(65) Prior Publication Data

US 2010/0331151 A1 Dec. 30, 2010

Related U.S. Application Data

(60) Provisional application No. 61/221,276, filed on Jun. 29, 2009.

(51) Int. Cl.
*A63B 21/075* (2006.01)
*A61H 1/00* (2006.01)

(52) U.S. Cl. ..... 482/94; 482/108; 601/73

(58) Field of Classification Search ..... 482/1, 44, 482/50, 92–94, 106–110, 141, 20, 49; 601/46, 601/67, 72, 73, 80, 81, 134, 137, 138; 473/587; 404/133.1

See application file for complete search history.

(56) References Cited

U.S. PATENT DOCUMENTS 850,938 A * 4/1907 Kellogg ..... 601/72
907,965 A * 12/1908 Calvert ..... 482/108
1,044,018 A * 11/1912 Calvert ..... 482/108
1,138,196 A * 5/1915 Diehl ..... 482/106
1,316,683 A * 9/1919 Calvert ..... 482/93
1,422,888 A * 7/1922 Reeves et al. ..... 482/93
D242,865 S * 12/1976 Stamm ..... D21/682
4,566,690 A 1/1986 Schook
5,072,933 A * 12/1991 Diodati ..... 482/93
5,102,124 A * 4/1992 Diodati ..... 482/107
5,807,215 A 9/1998 Abe et al.
5,868,653 A * 2/1999 Klasen ..... 482/110
6,039,679 A * 3/2000 Yu ..... 482/110
2007/0004558 A1 * 1/2007 Johansson ..... 482/1

(Continued)

FOREIGN PATENT DOCUMENTS

CN 201279368 Y * 7/2009

(Continued)

OTHER PUBLICATIONS

Would You "Shake Weight" for Arms Like Michelle Obama? Shape Up! Health & Fitness. http://www.glamour.com/health-fitness/blogs/shape-up/2009/08/would-you-shake-weight.

(Continued)

*Primary Examiner* — Loan Thanh
*Assistant Examiner* — Victor K Hwang
(74) *Attorney, Agent, or Firm* — Mayback & Hoffman, P.A.; Gregory L. Mayback; Rebecca A. Tie

(57) ABSTRACT

A handheld, vibratory exercise device with a handle that has a low center of gravity and selectively removable modular weights for incorporating an adjustable and additional resistance. The present invention is a vibratory system with a hand-held resistance device that may have a pendulous shape of "low center of gravity" or "low center of mass" and adjustable weights and thereby provides the opportunity for a unique, multi-faceted neuromuscular load.

19 Claims, 27 Drawing Sheets

U.S. PATENT DOCUMENTS

| | | | | |
|---|---|---|---|---|
| 2007/0135274 | A1 | 6/2007 | Blateri | |
| 2007/0270726 | A1 * | 11/2007 | Chou | 601/70 |
| 2007/0298941 | A1 * | 12/2007 | Egger | 482/108 |
| 2008/0139370 | A1 * | 6/2008 | Charnitski | 482/139 |
| 2009/0177126 | A1 * | 7/2009 | Berger et al. | 601/23 |

FOREIGN PATENT DOCUMENTS

| | | | | |
|---|---|---|---|---|
| JP | 9201429 | | | 8/1997 |
| JP | 09201429 | A | * | 8/1997 |
| JP | 3155308 | U | * | 11/2009 |
| SU | 1623671 | A | * | 1/1991 |
| SU | 1662589 | A1 | * | 7/1991 |
| WO | 2009000487 | | | 12/2008 |

OTHER PUBLICATIONS

The Shake Weight Arm-Sculpting Craze Shaking up a Media Frenzy. Reuters. http://www.reuters.com/article/pressRelease/idUS204156+06-Aug-2009+EBW20090806.

Can Vibration Plates Shake off Weight? WebMDHealth. http://www.medscape.com/viewarticle/702756.

Cochrane, Darryl, et al., "Effects of Acute Upper-Body Vibration on Strength and Power Variables in Climbers," Journal of Strength and Conditioning Research, 2007 21(2), 527-531.

Cochrane, D.J., et al., "The acute effect of vibration exercise on concentric muscular characteristics," Journal of Science and Medicine in Sport (2008) 11, 527-534.

Galileo Dumbell, http://www.galileo2000.de/en/produkte.php?t=1.

* cited by examiner

VIBRATORY EXERCISE DEVICE WITH LOW CENTER OF GRAVITY AND MODULAR WEIGHTS

CROSS-REFERENCE TO RELATED APPLICATIONS

This application claims the priority, under 35 U.S.C. §119, of U.S. Provisional Patent Application Ser. No. 61/221,276, filed Jun. 29, 2009, the entire disclosure of which is hereby incorporated herein by reference in its entirety.

FIELD OF INVENTION

The present invention lies in the field of resistance training exercise equipment. More specifically, the present disclosure relates to a handheld, vibratory system with a pendulous shape that incorporates modularly connected weights to increase resistance.

BACKGROUND OF THE INVENTION

In an effort to achieve physical fitness, people of all sizes, ages and physical abilities have used weight lifting, resistance training or conditioning as measures for improving or gaining muscle strength and tone throughout the body by lifting weights against the downward force of gravity. In one form of weight training, free weights that do not limit the user to a specific movement or exercise, such as dumbbells and barbells and a number of variations thereof, are used to perform repetitive lift exercises or are carried or moved during other exercise movements that are performed in conjunction with carrying the weights. Free weights are usually available in a set of individual weights of incremental weight amounts or, in the case of dumbbells and barbells, may be comprised of a set of modular plates of incremental weight that are assembled in weight stacks whereby each plate in the stack has a central hole through which the dumbbell or barbell shaft fits. The specific amount of weight of the free weights are chosen or adjusted based upon the targeted muscle, the type and desired result of the exercise and the physical ability of the particular user. Athletes have used free weight systems, including modular plates, to increase or decrease the counterweight loads during resistance training exercises by adjusting the total weight of the weight stack by increasing or decreasing the size and number of modular plates in the weight stack.

With respect to free weights, competitive athletes have used kettle bells (or kettlebells or Russian kettlebells) for decades to develop explosive multi joint strength and power. Generally, a kettle bell is comprised of a ball-like or other shaped weight (e.g., a cannon ball) and a handle. Kettle bells are usually constructed of solid cast iron and come in a variety of different and incremental weights associated with their particular mass and girth. In contrast with a typical barbell or dumbbell weight, the kettle bell's low center of mass relative to its handle makes the kettle bell especially functional in exercises that use dynamic swinging or arcing movements designed to incorporate the entire body as a functional "kinetic chain" that transfers strength and power through the muscles in a series of linked movements across a variety of angles.

However, despite the unique form of exercise provided by the kettle bell, existing kettle bell designs have a number of disadvantages. For example, unlike existing dumbbells and barbells, the weight amount of an individual kettle bell is typically not adjustable and therefore, unfortunately, a variety of individual kettle bells of differing sizes and weights are needed to provide a range of weight amounts. Disadvantages of such sets include the amount of storage space needed to store the set and the drastic increase in the cost of purchasing an entire set. Accordingly, it would be desirable to have an individual kettle bell whose total weight amount is adjustable.

In connection with neuromuscular exercise and resistance training, acute vibration has also been applied to the body during exercise and, as documented in scientific literature, has demonstrated a positive impact on improving muscle strength, muscle power and balance. See e.g., Cochrane D. J., et al., "The Acute Effect of Vibration Exercise on Concentric Muscular Characteristics," *Journal of Science and Medicine in Sport,* 11(6): 527-534 (2008). Currently, there exists a number of whole body vibration platforms designed to target the lower body musculature and there exists a limited number of devices, namely vibration plates, that apply vibration over a relatively large surface are of the upper body in an effort to trim abdominal fat. There also exist a limited number of devices that apply vibration to the upper body musculature using vibrating cables, dumbbells and barbells. One form of perturbating dumbbell is available commercially and is referred to as the Galileo® Up-X Dumbbell and is made by the German company, Galileo Systems. According to the scientific literature, the oscillatory movements of the muscle, as a result of the vibration, are thought to cause the rapid repeating of eccentric/concentric muscle contractions and the stretching of the muscle fibers thereby increasing the metabolic rate of the muscle.

However, there are disadvantages associated with the existing devices for applying vibration to the body musculature. For example, the majority of the small number of upper body devices that have incorporated vibration technology in them are relatively cumbersome, bulky and heavy due to the added vibration capabilities and therefore, are limited in the ways that the devices can be used and without causing tissue damage in comparison to conventional free weights. Accordingly, it would be desirable to have a device that effectively imparts a vibration to the upper body muscles and yet, has the size, weight and shape that is similar to a conventional free weight so that it may be used with the relative ease and range of movements provided by a free weight.

In another example, the vibration capabilities in the existing devices are generally not battery-operated and therefore, power cables are necessary to supply power to the device. Thus, the freedom to move the device is further constrained by the fact that it is tethered by the power cable. Therefore, it would also be desirable to have a device that effectively imparts a vibration to the upper body muscles that does not require a power cable connection between the device and the power source in order to provide power to the device.

In addition, currently there are no existing devices having some type of vibration technology that resemble a kettle bell having a low center of gravity or center of mass. As used herein, the term "low center of gravity" or "low center of mass" is defined to mean that more than half of the weight associated with the device is placed below a plane parallel to the floor and bisecting the kettle bell between its upper and lower extremities when the latter of which is resting on the floor in a storage position. Such a device allows the dynamic swinging and support exercises that are available with a kettle bell to be combined, along with the added training stimulus provided by vibration. Thus, it would be desirable to have a kettle bell-like device that incorporates into it some type of vibration technology for imparting an oscillatory force on the muscles of the upper body.

Therefore, a need exists to overcome the problems with the prior art as discussed above.

The present invention combines a vibratory system with a hand-held resistance device having a pendulous shape of "low center of gravity" or "low center of mass" and adjustable weights and thereby provides the opportunity for a unique, multi-faceted neuromuscular load. The vibration caused by the vibratory technology, for example, by the device's internal motor, causes alternating accelerations towards and away from the pull of gravity. The vibratory oscillations increase the acceleration on the device. The laws of physics state that the amount of force ("F") imparted by an accelerating object is equal to the object's mass ("m") multiplied by its acceleration ("a"). Thus, F=ma. Accordingly, the increase in acceleration due to the vibratory activity of the device can therefore advantageously increase the force or resistance that the device transfers to the muscles without ever adjusting the object's mass. However, in conjunction with the benefits created by the vibratory activity of the device, the device of the present invention also provides a unique system for adjusting the weight or mass of the device. In this way, both the mass and acceleration of the device can be used to train the neuromuscular system.

Viewing acceleration and mass separately provides a picture of how each of these overloads can act synergistically to improve the neuromuscular fitness of the user. For example, as discussed in detail below, an exemplary embodiment of the present invention has a vibratory motor mounted towards the bottom of the device as far as possible from the device's handle. This creates a long lever arm from the handle to the vibratory source and therefore, mechanically increases the impact of the vibration during exercise performance. Additionally, the lever arm length, i.e. the length between the handle and the vibratory motor, has been designed so that the device provides the optimal frequencies, i.e. 25-35 Hz, for maximizing the neuromuscular response while minimizing the potential for muscle, connective tissue, neuronal or vascular damage.

With respect to the mass aspect of the device, the counterweight system of the present embodiment is attached to the vibratory motor shaft and features two parallel mounted weights. Because the device is intended to move through various planes of motion during exercise and the displacement caused by the vibratory motor is multidirectional, the vibratory stimulus will be applied in multiple directions allowing the neuromuscular improvements to occur in multiple places of movement, as opposed to the single plane of movement response that is common with standard, conventional resistance training equipment.

As a result, the level of neuromuscular activity is increased when the vibratory stimulus is applied and therefore, the level of fatigue, as measured by time to failure, is increased. Putting these two facts together, the device of the present invention has the potential to offer a more efficient, less time-consuming and more palatable exercise option compared to standard exercise equipment and techniques.

SUMMARY OF THE INVENTION

Embodiments of the present invention provide a vibratory exercise device, comprising an upper portion having a handle portion for gripping the device and a body portion, a base portion capable of being removably attached to the upper portion, a vibratory unit mechanically connected to at least one of the upper and base portions and capable of causing the respective at least one of the upper and base portions to vibrate, and at least one modular weight, the upper and base portions capable of selectively removably holding the at least one modular weight therebetween such that when so holding the at least one modular weight, the upper portion, the at least one modular weight and the base portion have a low center of mass.

With the objects of the invention in view, there is also provided a handheld, vibratory exercise device comprising an upper portion having a handle portion for gripping the device and a body portion, a base portion capable of being removably attached to the upper portion, a vibratory unit mechanically connected to at least one of the upper and base portions and capable of causing the respective at least one of the upper and base portions to vibrate, and a plurality of selectively removable modular weights, the upper and base portions capable of removably holding therebetween the plurality of selectively removable modular weights in a serial vertical stack, the handle and base portions and the plurality of selectively removable modular weights having a pendulum-type ball exterior shape with a low center of mass.

With the objects of the invention in view, there is further provided a handheld, vibratory exercise device comprising an upper portion having a handle portion for gripping the device and a body portion, a base portion capable of being removably attached to the upper portion, the upper and base portions capable of cooperatively holding therebetween at least one selectively removable modular weight, and a vibratory unit mechanically connected to at least one of the upper and base portions and capable of causing the respective at least one of the upper and base portions to vibrate, the upper and base portions together with the vibratory unit having a low center of mass.

Additional advantages and other features characteristic of the present invention will be set forth in the detailed description which follows and may be apparent from the detailed description or may be learned by practice of exemplary embodiments of the present invention. Still other advantages of the present invention may be realized by any of the instrumentalities, methods, or combinations particularly pointed out in the claims.

Although the invention is illustrated and described herein as embodied in a handheld, vibratory exercise device with a handle that has a low center of gravity and modular weights for incorporating an adjustable and additional resistance, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the present invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting, but rather, to provide an understandable description of the invention. While the specification concludes with claims defining the features of the invention that are regarded as novel, it is believed that the present invention will be better understood from a consideration of the following description in conjunction with the drawing figures, in which like reference numerals are carried forward.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention. Advantages of embodiments of the present invention will be apparent from the following detailed description of the preferred embodiments thereof, which description should be considered in conjunction with the accompanying drawings in which.

DETAILED DESCRIPTION OF THE INVENTION

Figure 2:
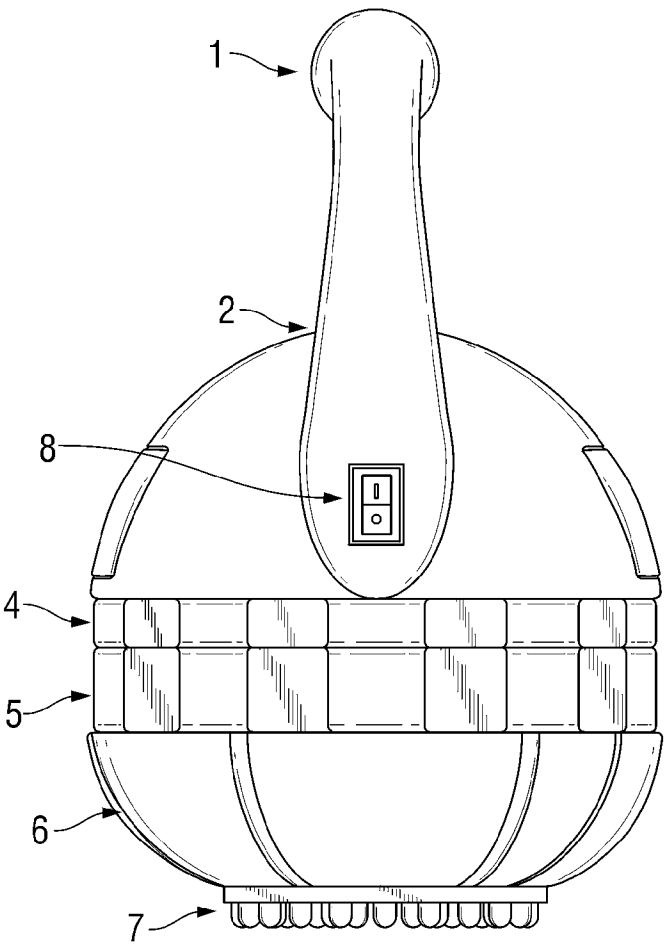
FIG. 2 is a left side elevational view of the exercise device of FIG. 1.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Alternate embodiments may be devised without departing from the spirit or the scope of the invention. Additionally, well-known elements of exemplary embodiments of the invention will not be described in detail or will be omitted so as not to obscure the relevant details of the invention.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

The device of the present invention provides a unique way to apply resistance to the body's musculature. The inventive device combines the pendulous power-oriented structure of a kettle bell with a vibratory unit and modular weight plates, the latter of which are used to increase and decrease the total weight of the device.

Figure 14D:
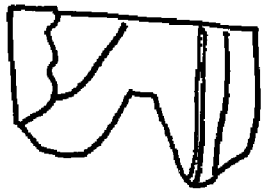
FIGS. 14A to 14E are additional elevational views of the front of the exercise device of FIG. 13A, including a depiction of the device in use in FIG. 14E.
Figure 14E:
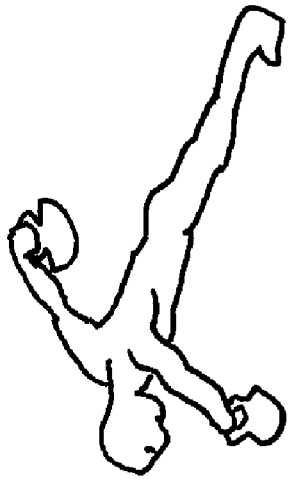
Figure 14A:
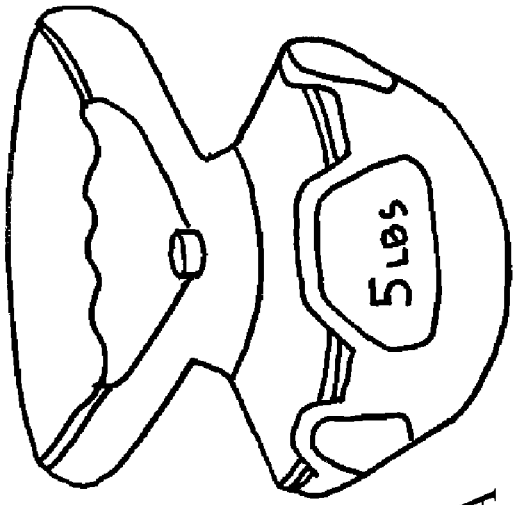
Figure 14C:
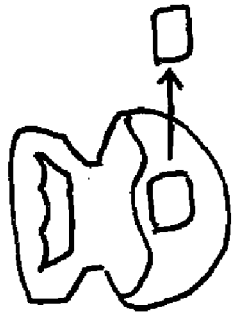
Figure 14B:
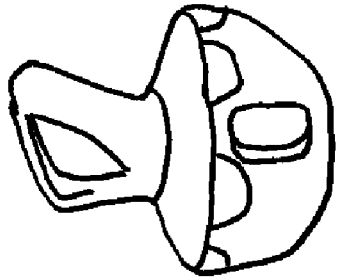
Figure 15B:
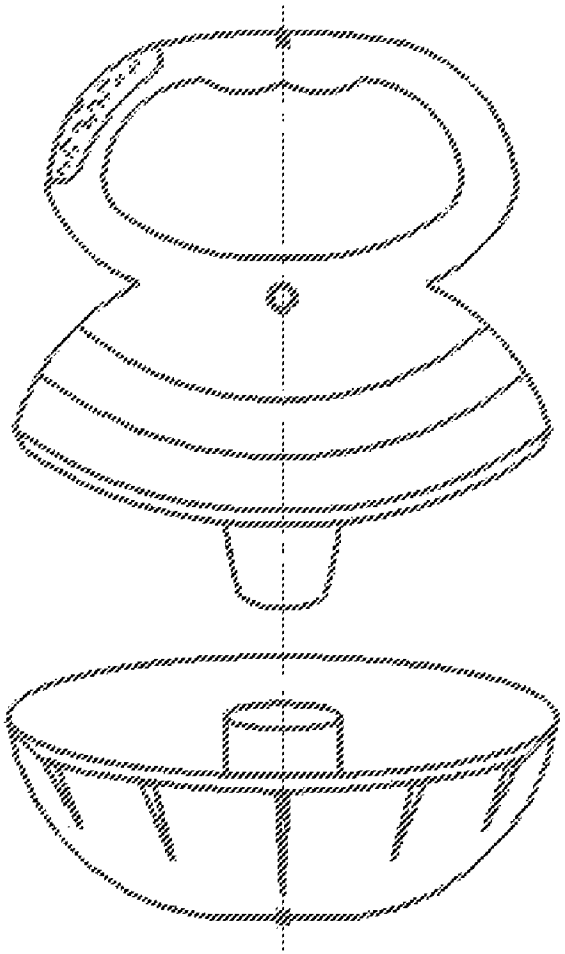
FIG. 15B is an exploded perspective view of the side of the exercise device of FIG. 15A.
Figure 15A:
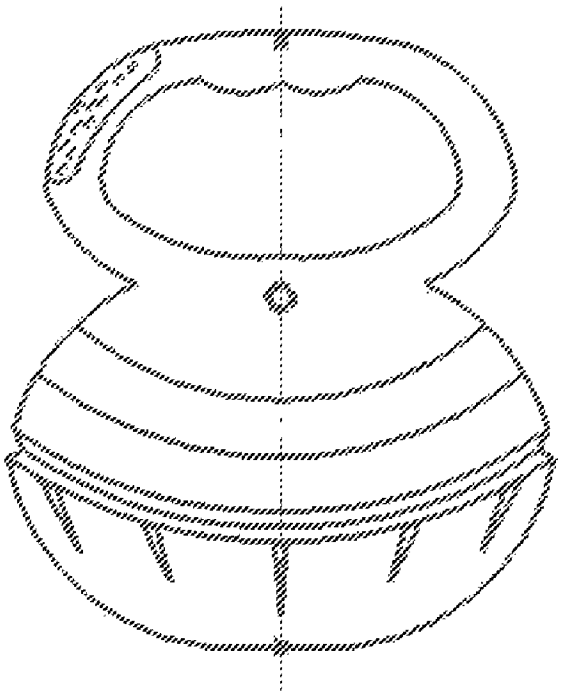
FIG. 15A is an elevational view of the front of a ninth exemplary embodiment of the exercise device according to the present invention.
Figure 16:
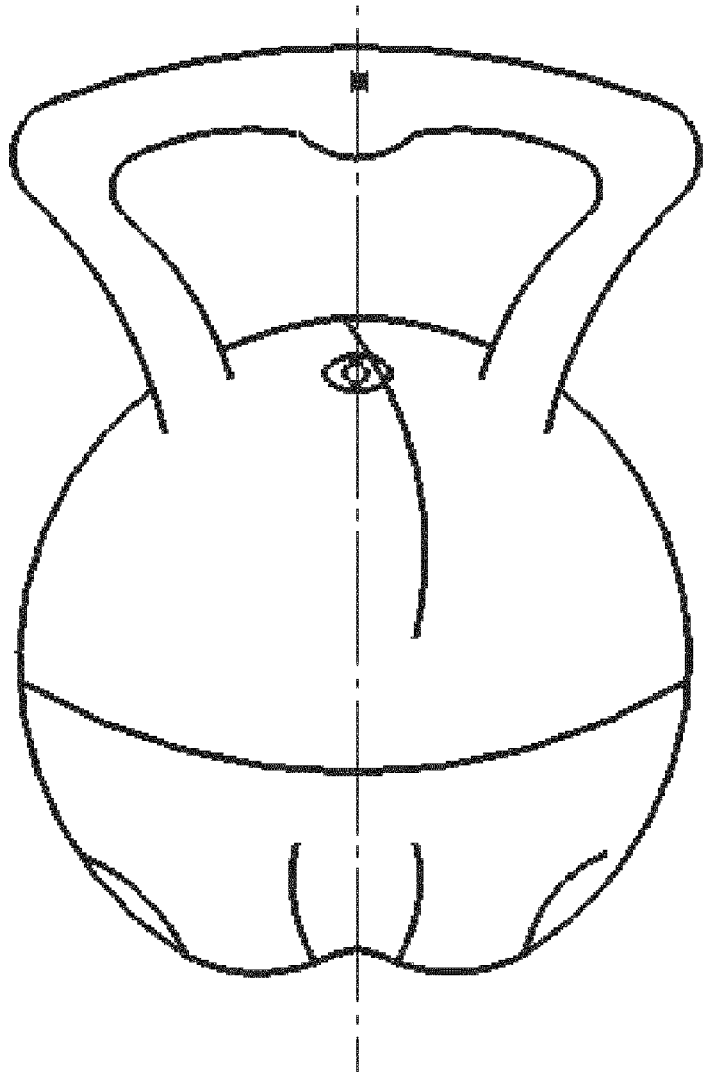
FIG. 16 is an elevational view of the front of a tenth exemplary embodiment of the exercise device according to the present invention.
Figure 17:
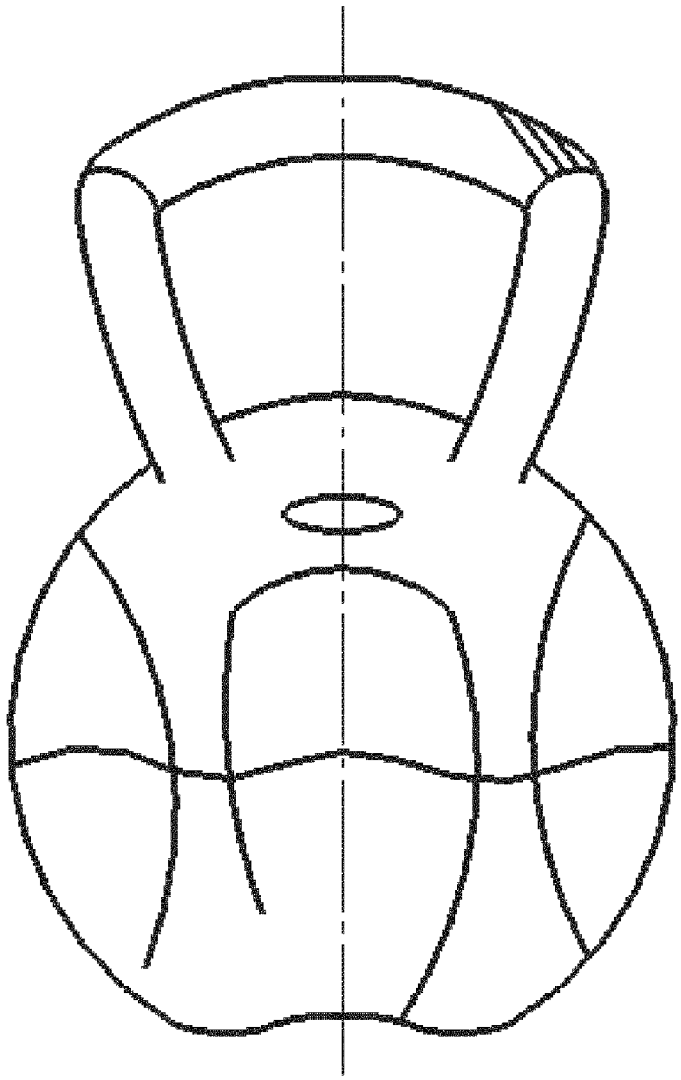
FIG. 17 is an elevational view of the front of an eleventh exemplary embodiment of the exercise device according to the present invention.
Figure 18:
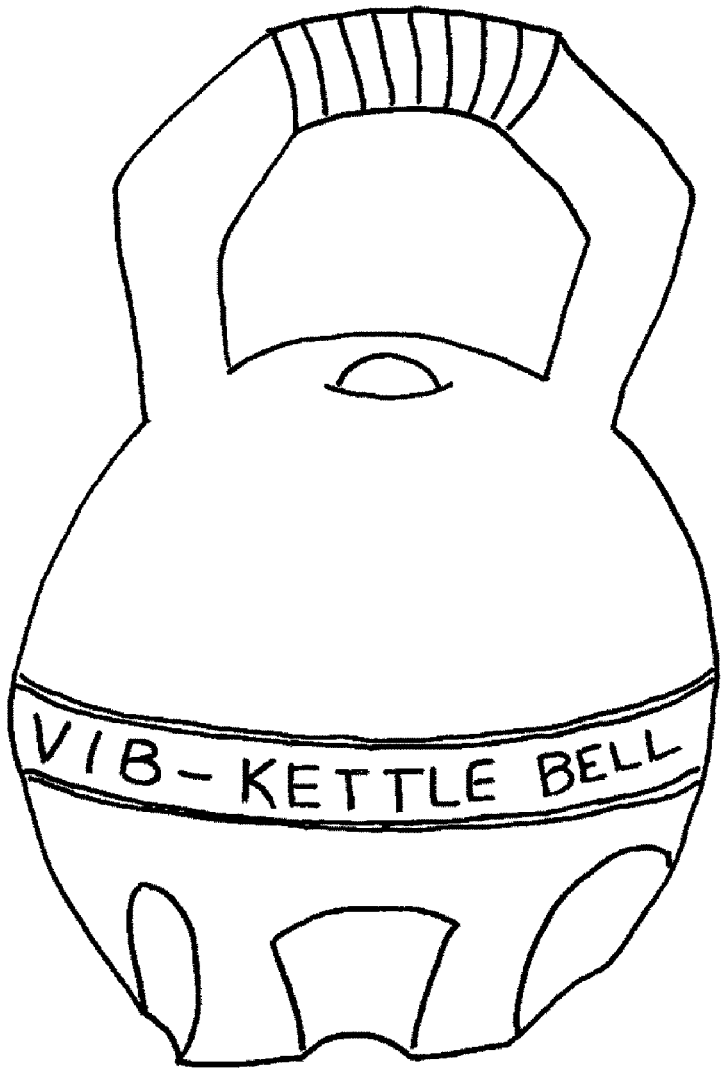
FIG. 18 is an elevational view of the front of a twelfth exemplary embodiment of the exercise device according to the present invention.
Figure 19A:
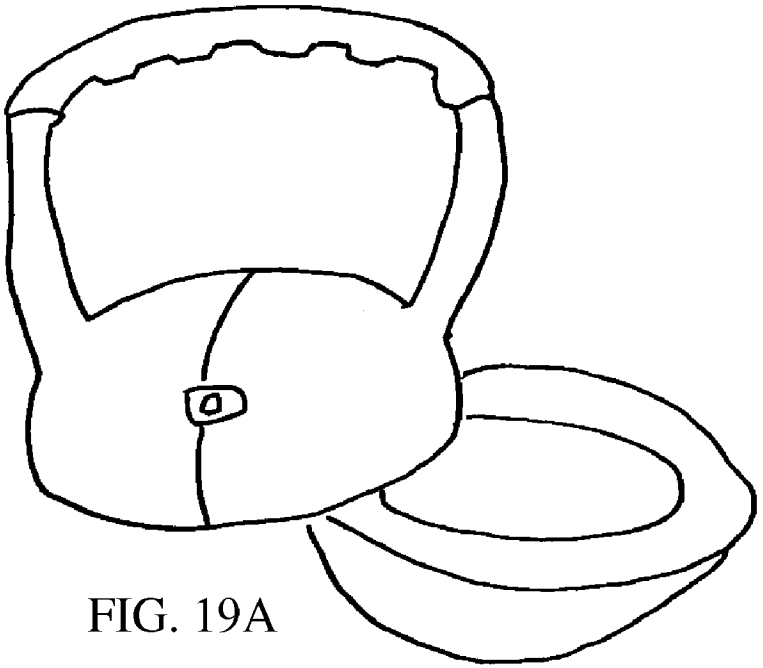
FIGS. 19A and 19B are perspective and elevational views of the side of a thirteenth exemplary embodiment of the exercise device having a pivoting hinge according to the present invention.
Figure 19B:
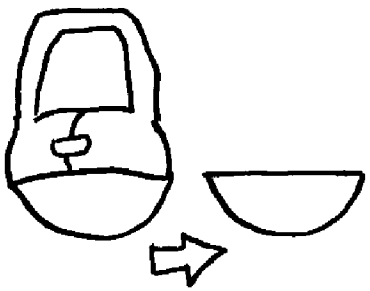
Figure 20A:
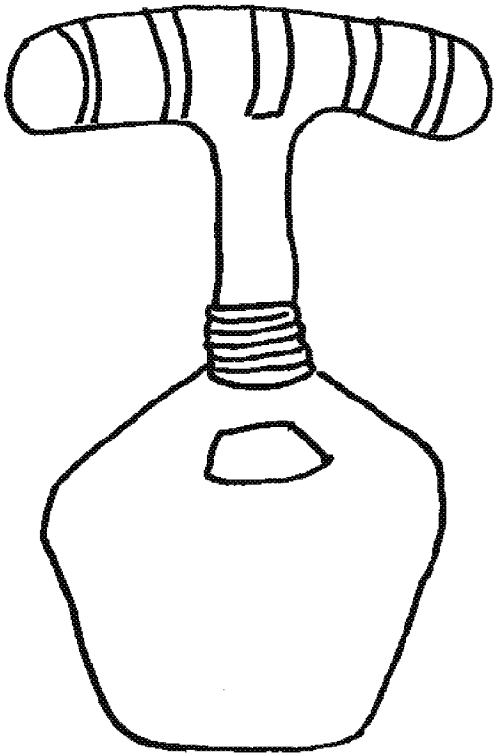
FIGS. 20A, 20B, and 20C are elevational and perspective views of the front of a fourteenth exemplary embodiment of the exercise device according to the present invention.
Figure 20B:
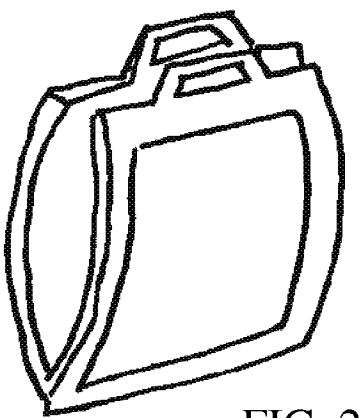
Figure 20C:
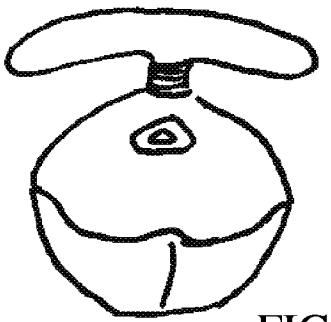
Figure 21B:
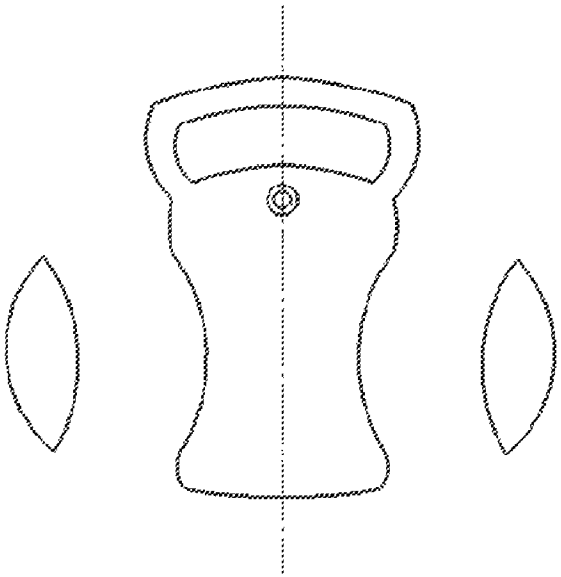
FIG. 21B is an exploded side view of the exercise device of FIG. 21A.
Figure 21A:
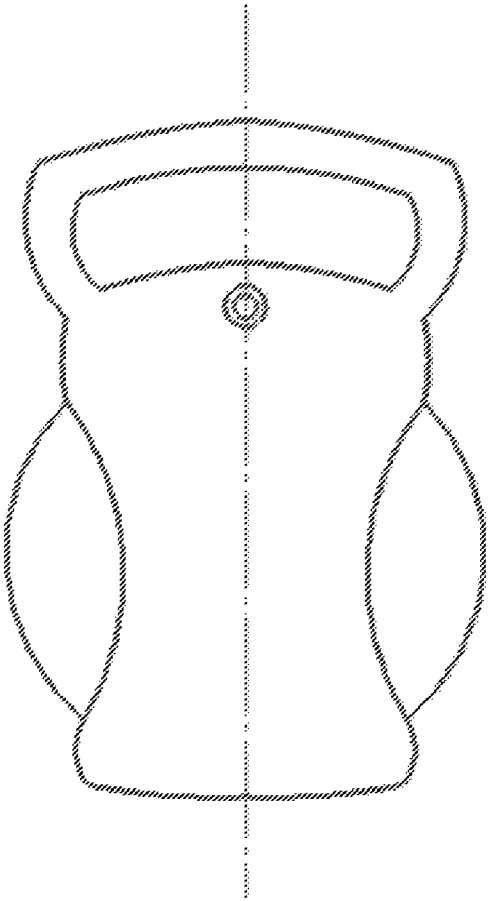
FIG. 21A is an elevational view of the front of a fifteenth exemplary embodiment of the exercise device according to the present invention.
Figure 22B:
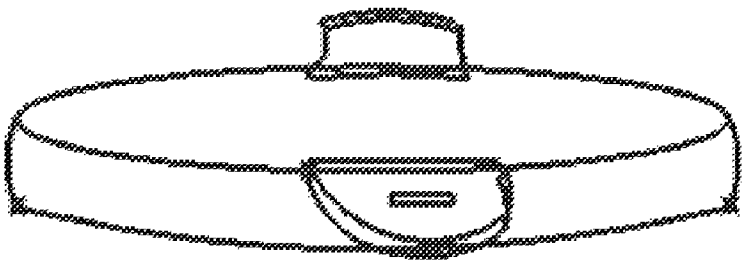
FIGS. 22A and 22B are elevational views of the front and a weight portion of a sixteenth exemplary embodiment of the exercise device according to the present invention.
Figure 22A:
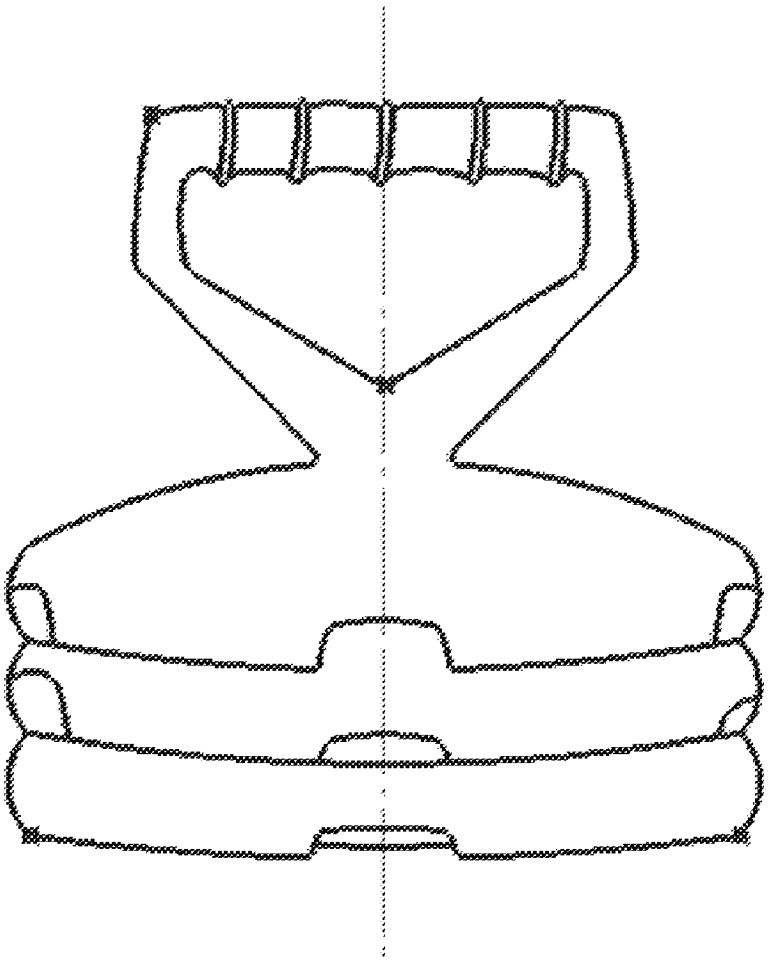
Figure 23B:
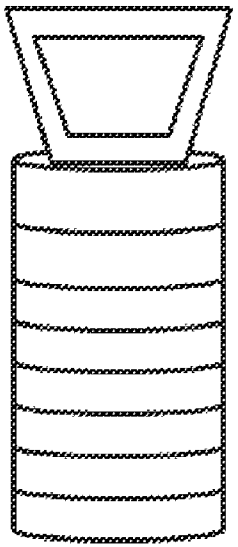
FIG. 23B is an elevational view of the front of a seventeenth exemplary embodiment of the exercise device according to the present invention.
Figure 23A:
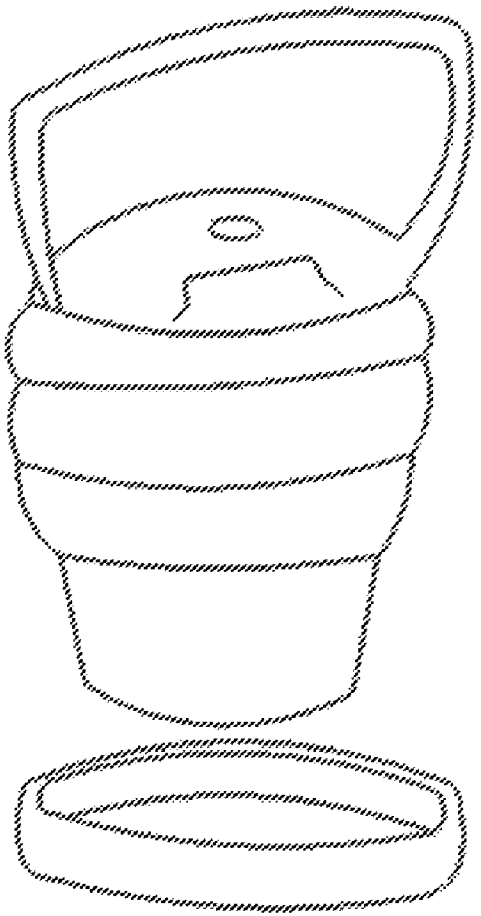
FIG. 23A is a partially exploded, perspective view
Figure 24B:
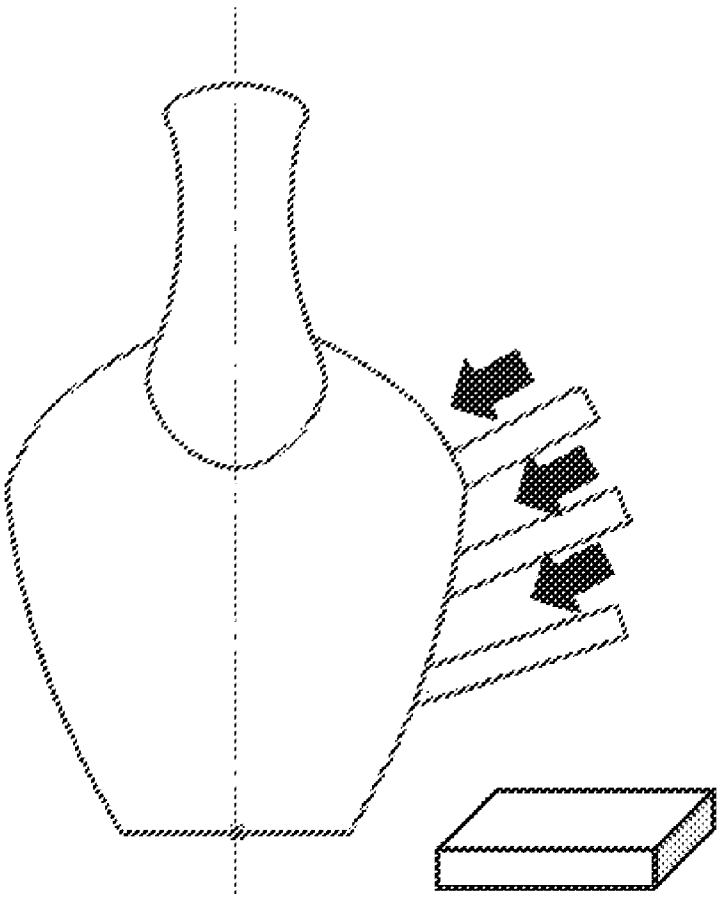
FIGS. 24A and 24B are elevational views of the front and side of a eighteenth exemplary embodiment of the exercise device according to the present invention.
Figure 24A:
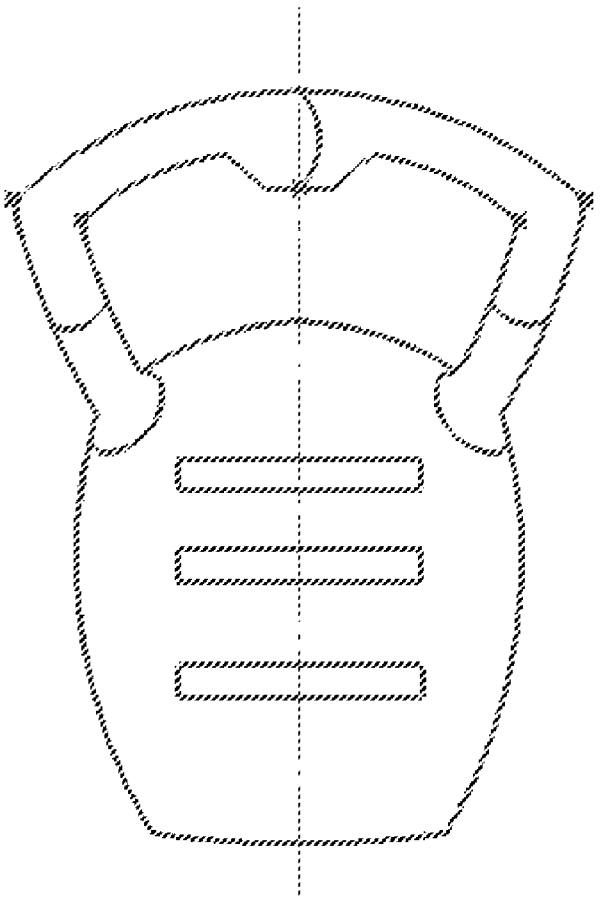
Figures 25A, 25B:
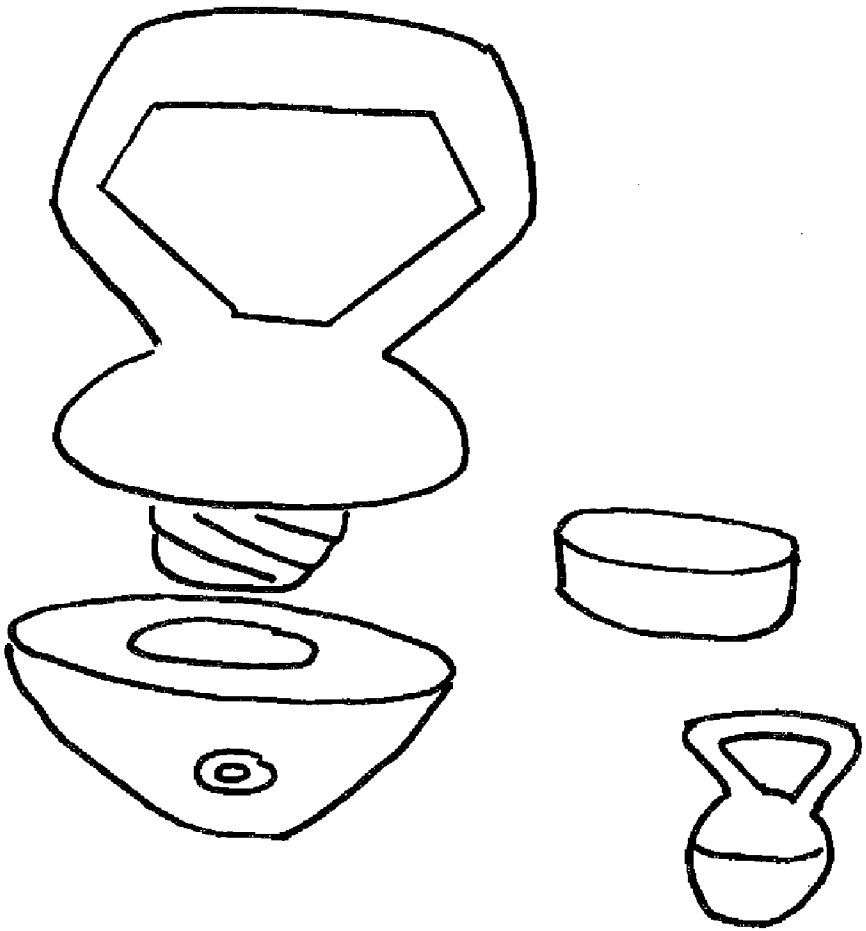
FIG. 25A is an exploded, perspective view
FIG. 25B is an elevational view of the front of a nineteenth exemplary embodiment of the exercise device according to the present invention.
Figure 26:
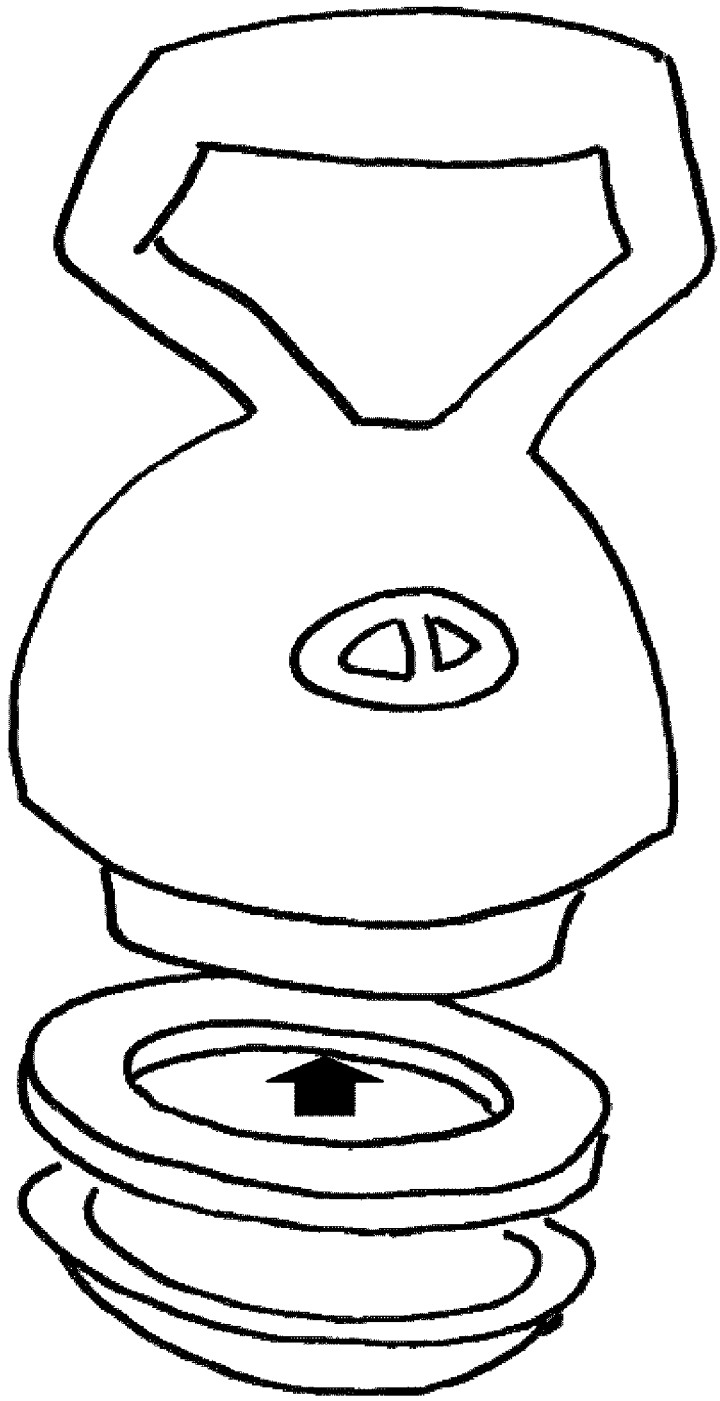
FIG. 26 is an exploded perspective view of the front of a twentieth exemplary embodiment of the exercise device according to the present invention.
Figure 27:
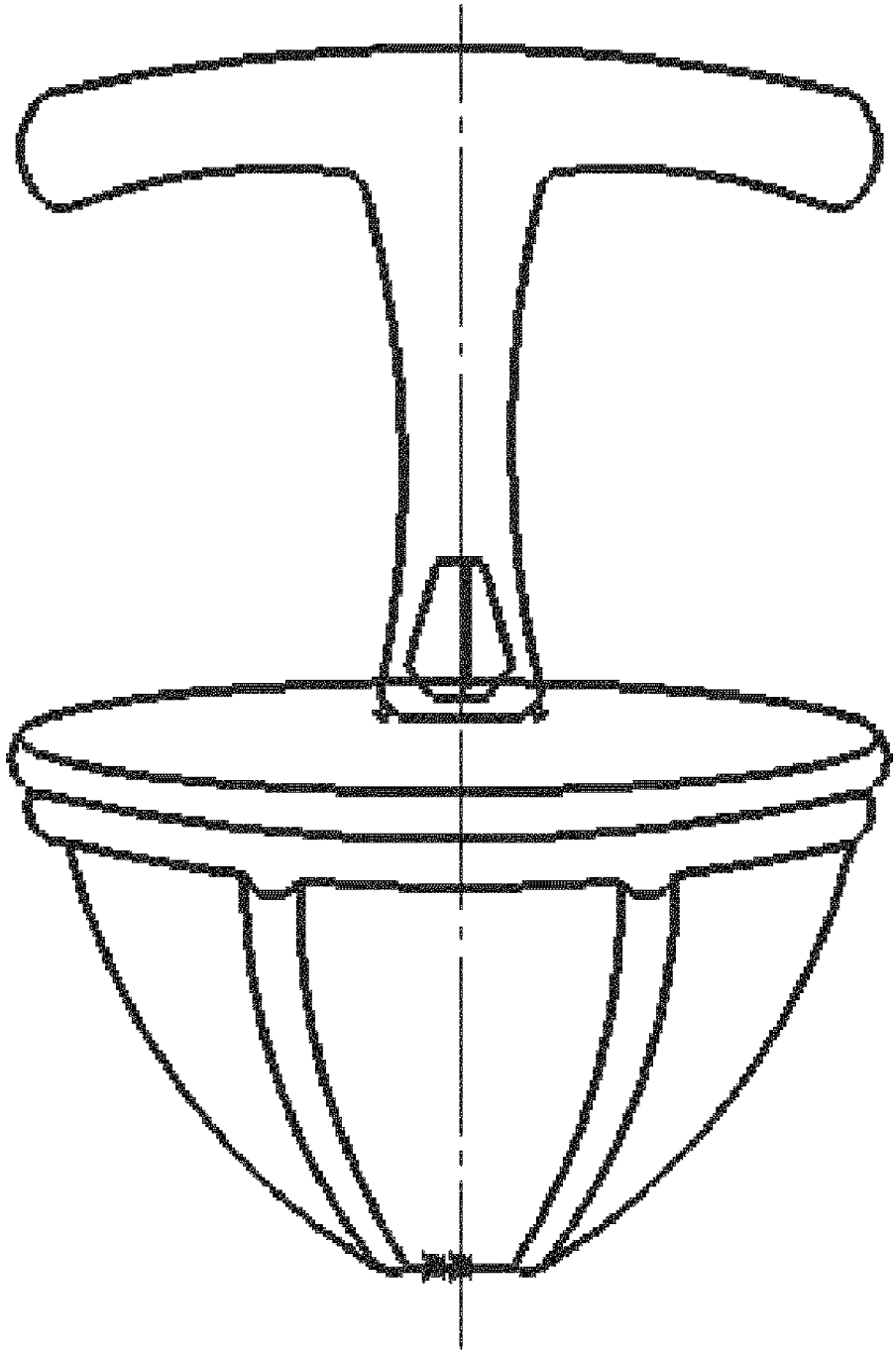
FIG. 27 is an elevational view of the front of a twenty-first exemplary embodiment of the exercise device according to the present invention.
Figure 28:
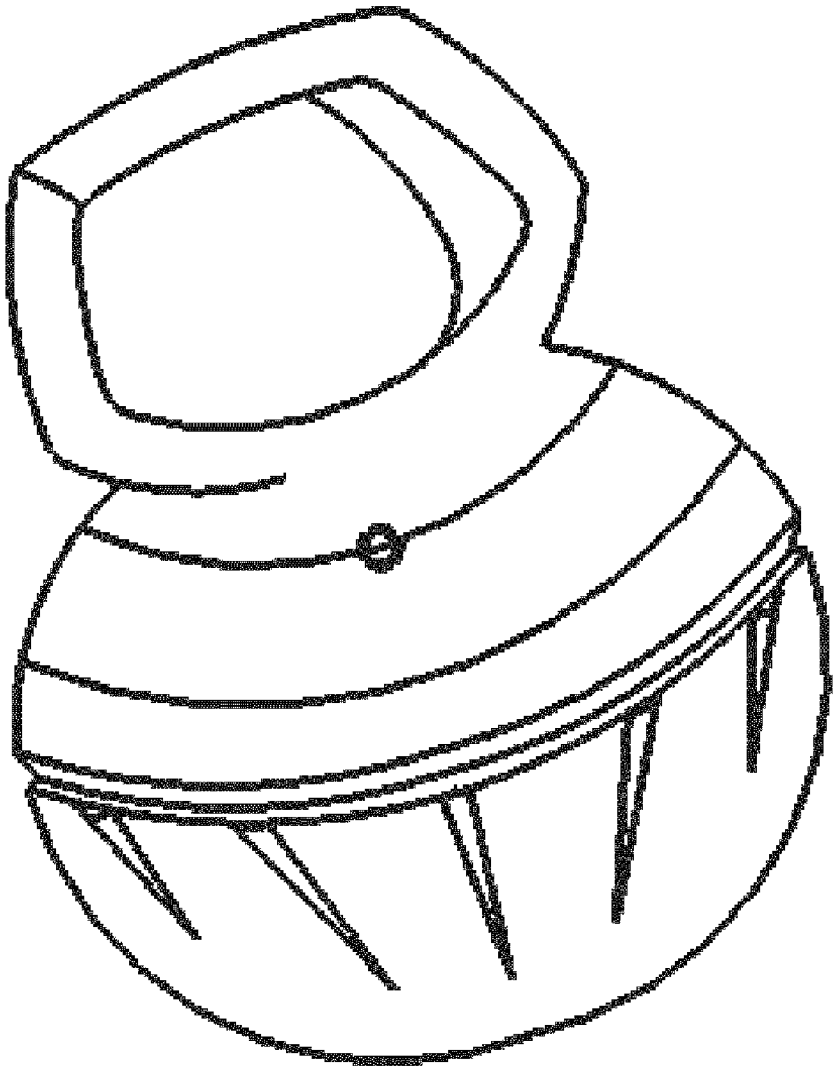
FIG. 28 is an elevational view of the front of a twenty-second exemplary embodiment of the exercise device according to the present invention.
Figure 29C:
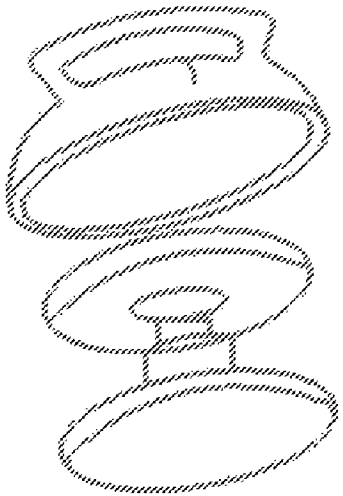
FIG. 29C is an exploded perspective view of the front of a twenty-third exemplary embodiment of the exercise device according to the present invention.
Figure 29A:
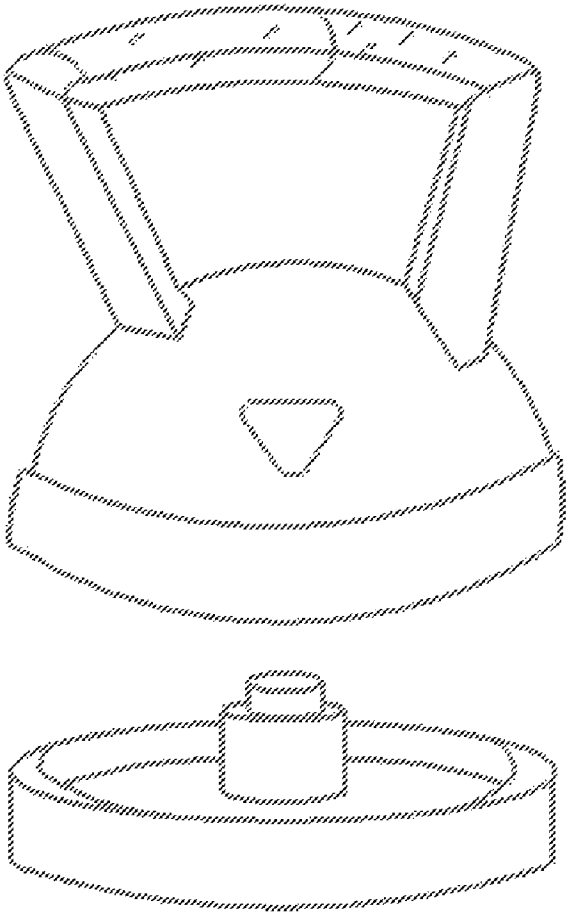
FIG. 29A is a partially exploded perspective view.
Figure 29B:
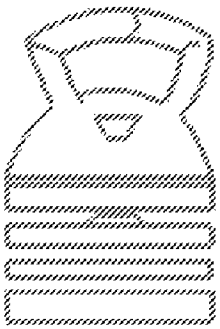
FIG. 29B is a partially exploded side elevational view.

The invention is a handheld, vibratory exercise device having a handle that places the center of gravity at a low position, e.g., a position opposite the handle and in an area that is closer to the flat base of the device than the handle when the device is at rest on the ground with the handle oriented upwards at the top of the device. Locating the handle at the top of the device allows it to be used in pendulum-type exercise movements that cannot be performed using dumbbells, barbells, or other resistive devices with the exception of kettle bells. The flat base of the device also allows the device to be used for upper body support exercises, for example, push-ups (see, e.g., FIG. 14E), that cannot be performed using conventional dumbbells, barbells, or other resistive devices with the exception of kettle bells. Unlike Russian kettle bells, which are typically comprised of solid, cast-iron, dead weights, the inventive device of the present invention has a kettle bell-like shaped shell exterior, but also has a hollow interior that contains a vibratory motor enclosed within the device's superstructure. In an exemplary embodiment, the shell is made of high-impact plastic.

Additionally, the device has a supplementary weight system that allows a user to adjust the total weight or the resistance load of the device to the desired amount for a particular exercise. The ability to add or remove weights gives the user the ability to change (i.e., increase or decrease, respectively) the resistance felt during the exercise. In an exemplary embodiment of the present invention, the weights are modular.

Referring now to the figures of the drawings in detail and first, particularly to FIGS. 1-6 thereof, there is shown a first exemplary embodiment of the exterior view of an exercise device according to the present invention. The exercise device 10 is comprised of a handle 1, a pendulum-like ball-shaped body 2, a battery access door 3 that houses a battery for powering the vibratory motor (see e.g., FIG. 6, described in detail below), a set of modular weights 4, 5 in the exemplary form of plates that are not enclosed in the body 2 and may be removed from the device, a base 6, and a footpad 7. For purposes of this embodiment, the body 2 and the base 6 are shown and described as being half-moon shaped such that when they are assembled together to form the device, their combined shapes form a pendulum-like ball shape. However, the body 2 and/or the base 6 are not limited to this shape and it is contemplated that the body 2 and base 6 can be constructed in a variety of shapes and sizes that effectively result in the exercise device having a low center of mass relative to its handle 1. Alternative designs for the shape and size of the body 2, base 6 and handle 1 are found in various embodiments of the present invention, including, but not limited to, those depicted in FIGS. 7-30.

Also, although the weight component of the device has been described above as a set of modular weights 4, 5 in the form of plates, it is contemplated that the weight component can be in the form of a single weight or a set of a plurality of weights, and can be of a variety of modular shapes, weight amounts and sizes that can be selectively removable from the body 2 of the device 10 such that the user can change the total weight of the device by adding, removing or interchanging the various weights. For example, in the exemplary embodiment shown in FIG. 1, the device 10 has a set of two modular weights plates 4, 5 of two different weight amounts. If desired, the first modular plate 4 can weigh, for example, 2.5 pounds, and the second modular plate 5 can weigh, for example, 5 pounds. As a result, when both plates 4, 5 are used, the device 10 has a combined total added weight of 7.5 pounds.

Figure 1:
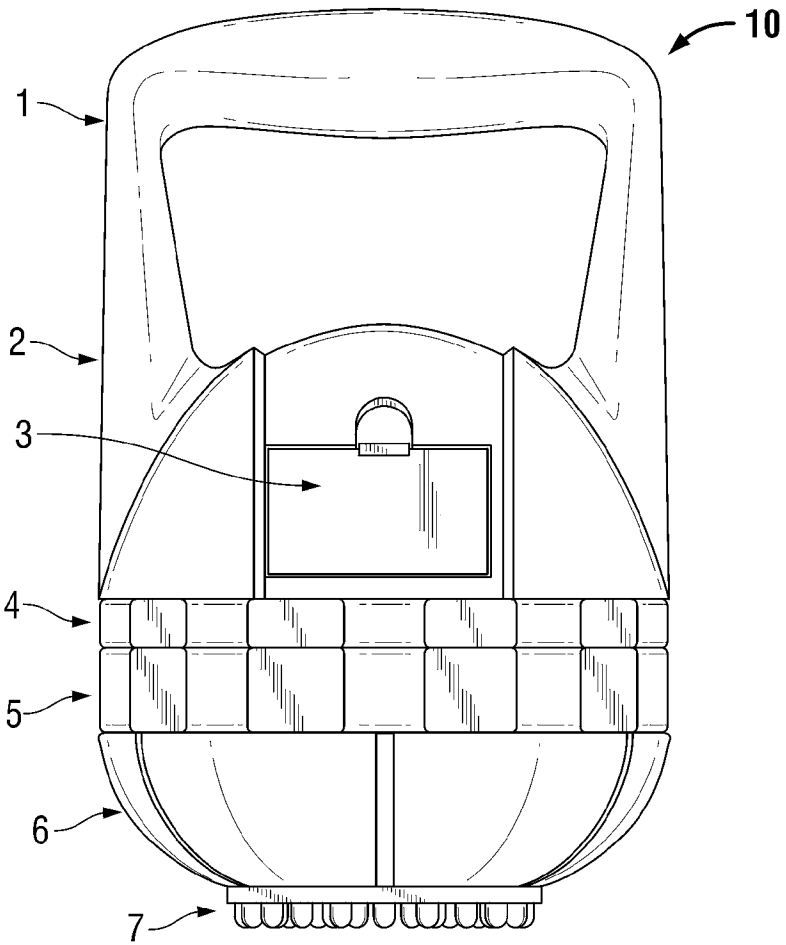
FIG. 1 is an elevational view of the front of a first exemplary embodiment of the exercise device according to the present invention.
Figure 3:
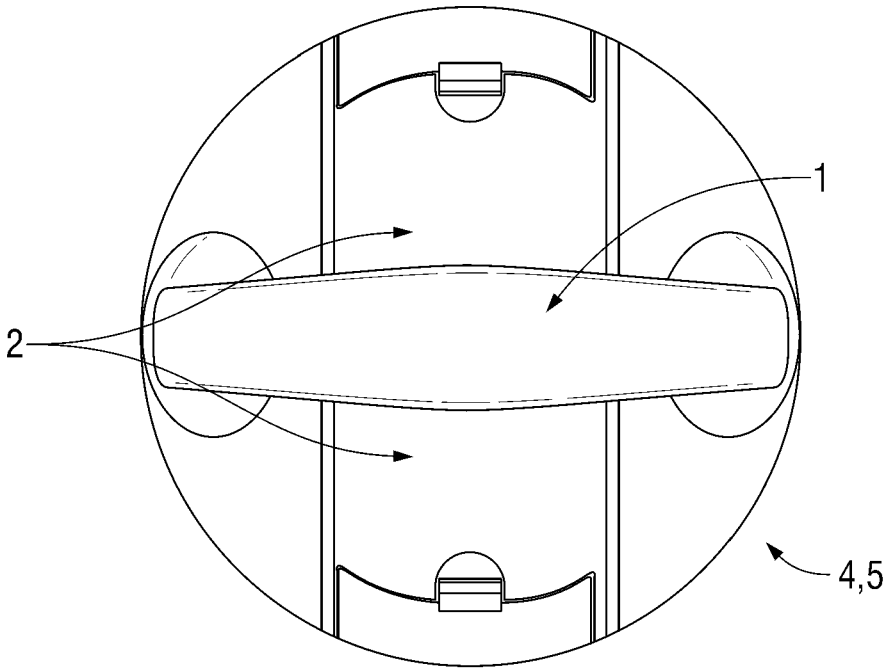
FIG. 3 is a top plan view of the exercise device of FIG. 1.
Figure 4:
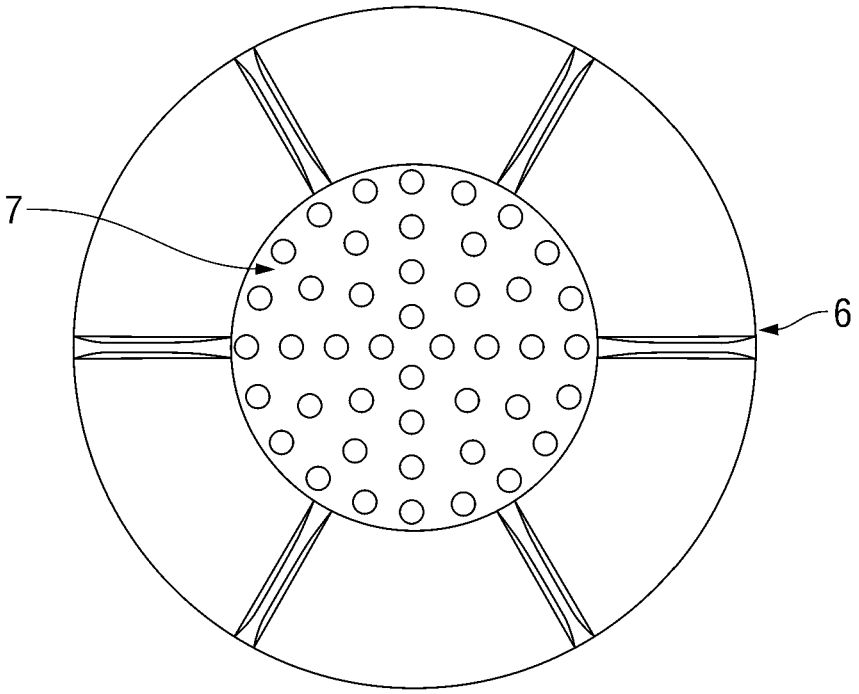
FIG. 4 is a bottom plan view of the exercise device of FIG. 1.
Figure 5:
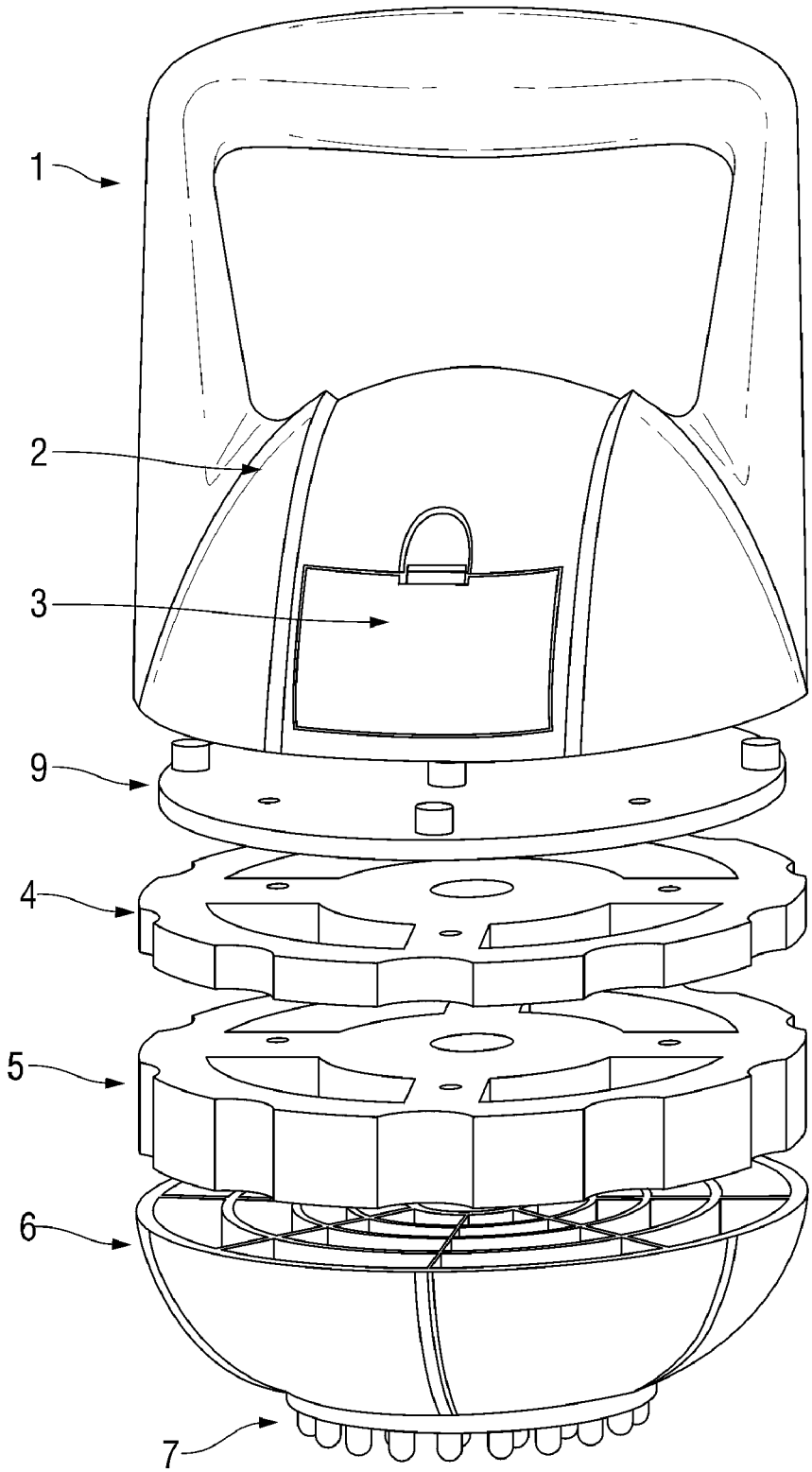
FIG. 5 is an exploded perspective view from the front left side of the exercise device of FIG. 1.
Figure 6:
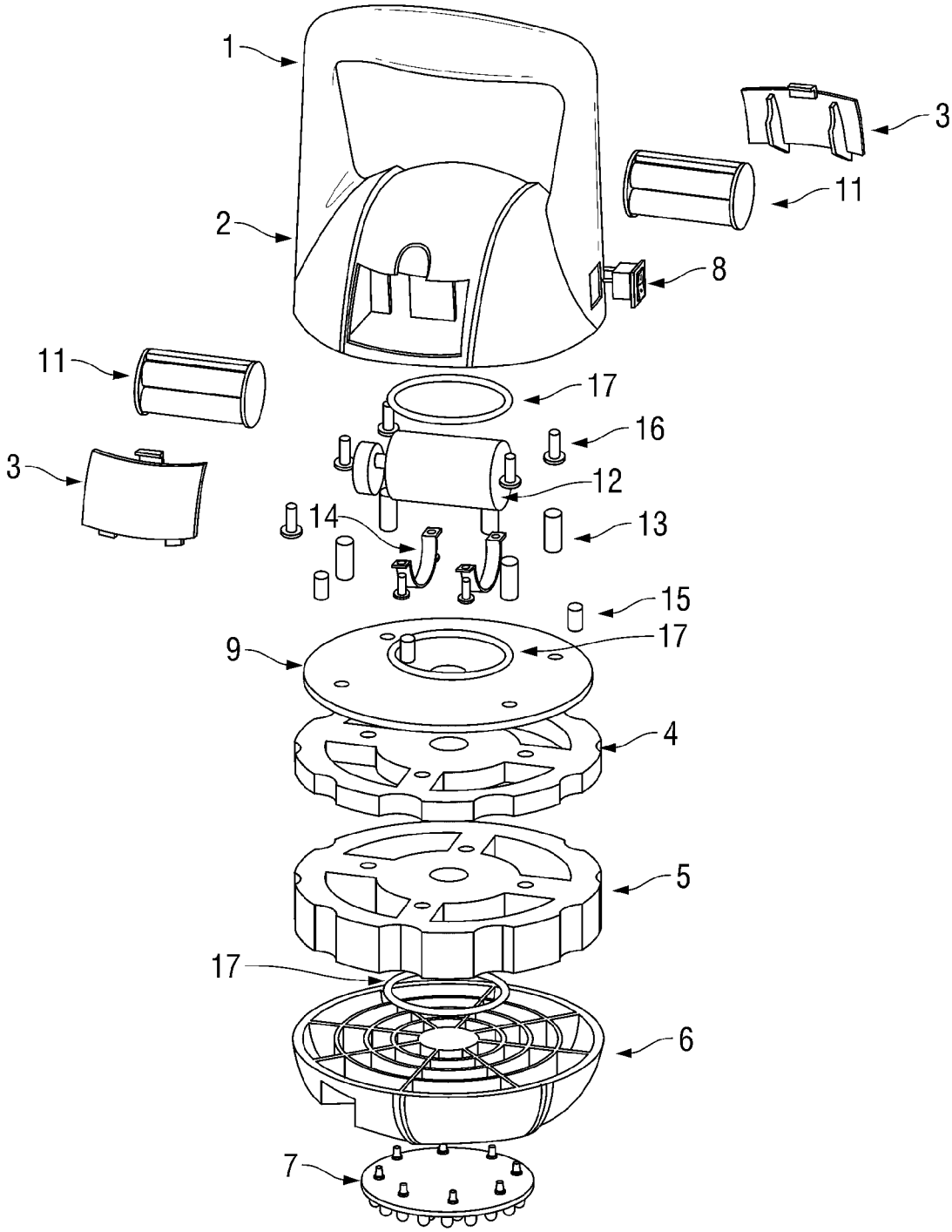
FIG. 6 is a further exploded view of the exercise device of FIG. 1.
Figure 7B:
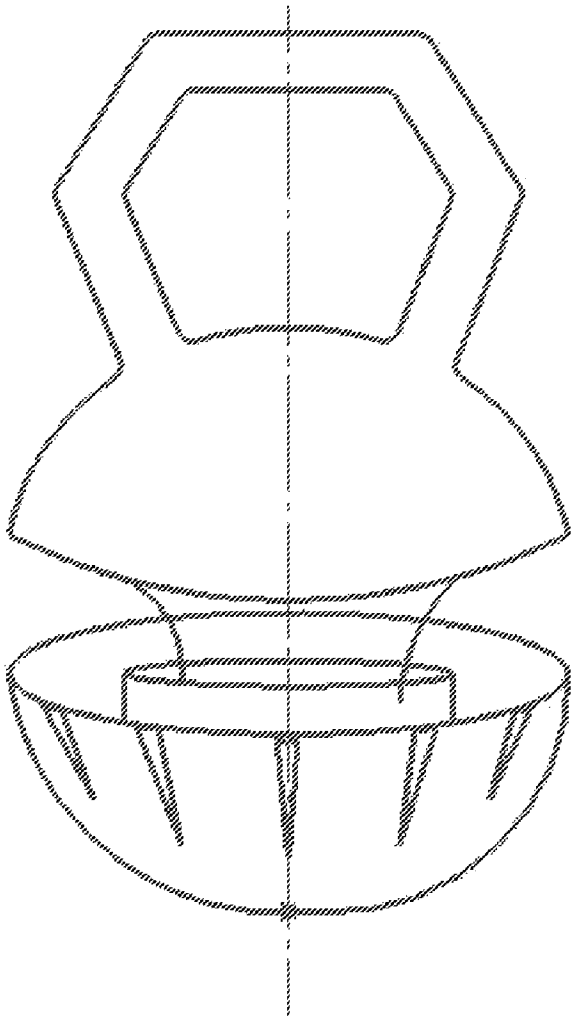
FIGS. 7A and 7B are elevational views of the front of a second exemplary embodiment of the exercise device according to the present invention.
Figure 7A:
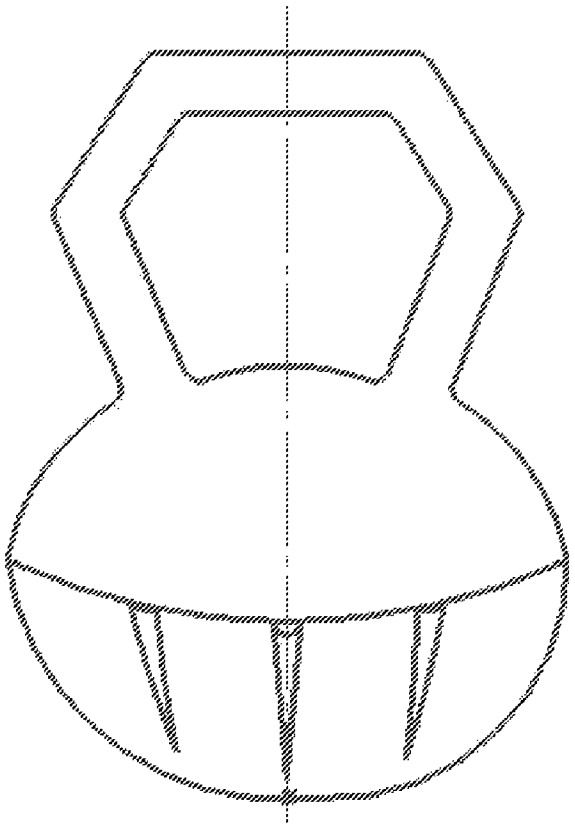
Figure 8B:
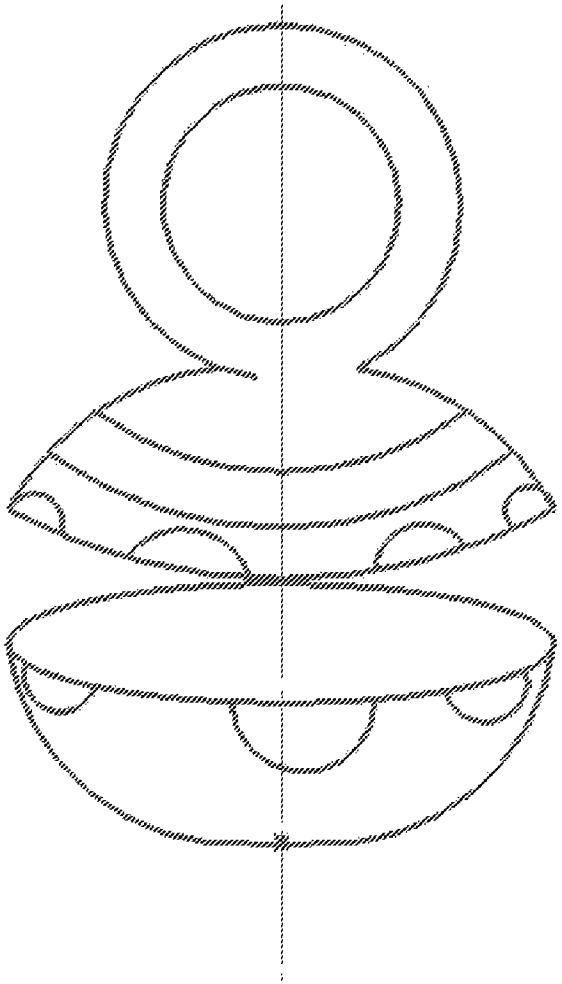
FIGS. 8A and 8B are elevational views of the front of a third exemplary embodiment of the exercise device according to the present invention.
Figure 8A:
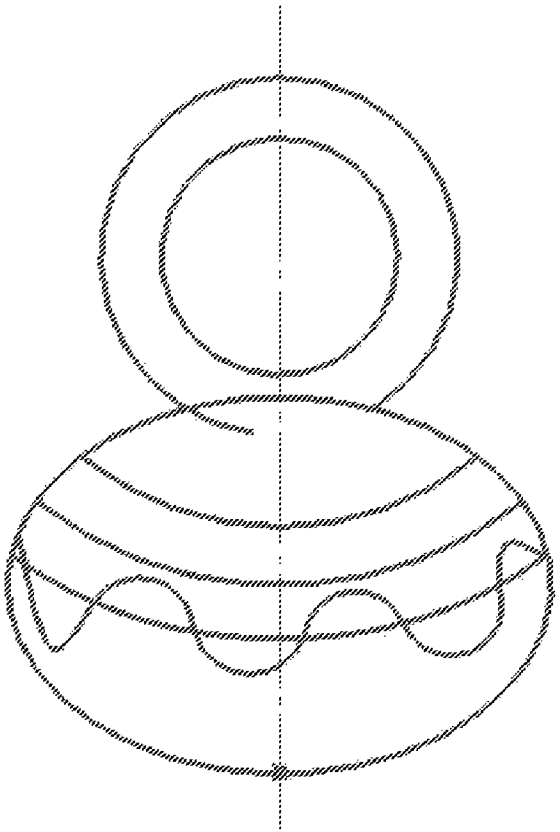
Figure 9A:
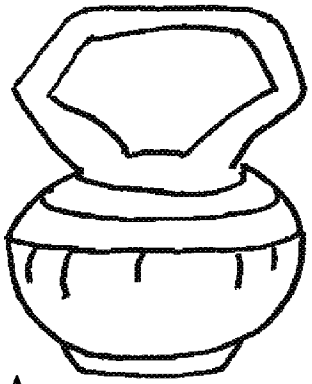
FIGS. 9A to 9G are elevational side views of several exemplary embodiments of the exercise device according to the present invention.
Figure 9B:
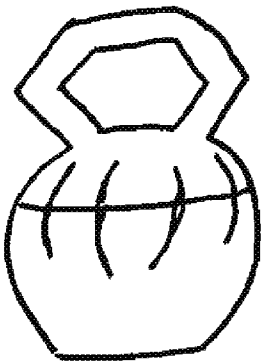
Figure 9C:
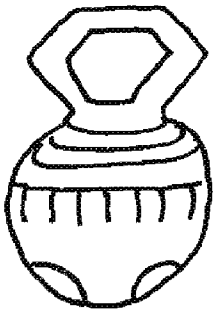
Figure 9D:
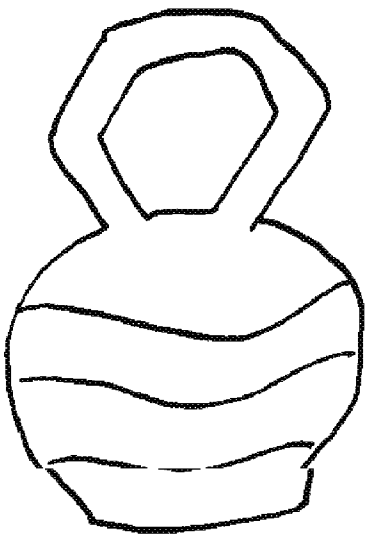
Figure 9E:
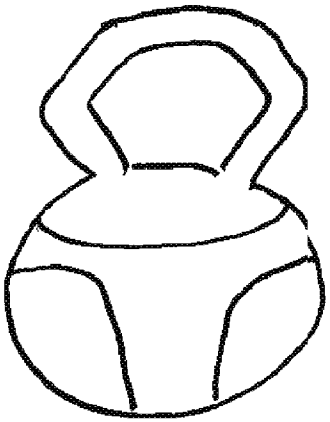
Figure 9F:
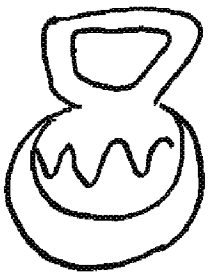
Figure 9G:
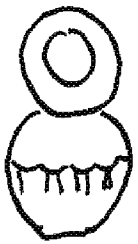
Figure 10B:
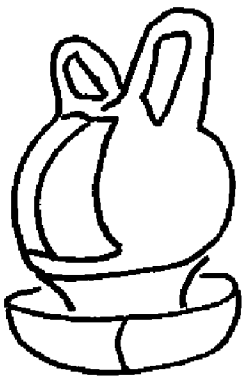
FIGS. 10A to 10B are elevational side views of the front and side of a fourth exemplary embodiment of the exercise device having two sub-handles according to the present invention.
Figure 30:
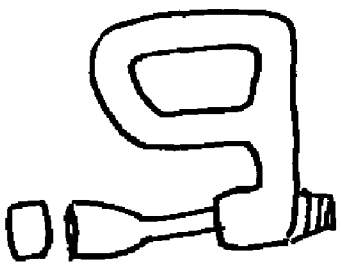
FIG. 30 is a side elevational view of a twenty-fourth exemplary embodiment of the exercise device according to the present invention.
Figure 10A:
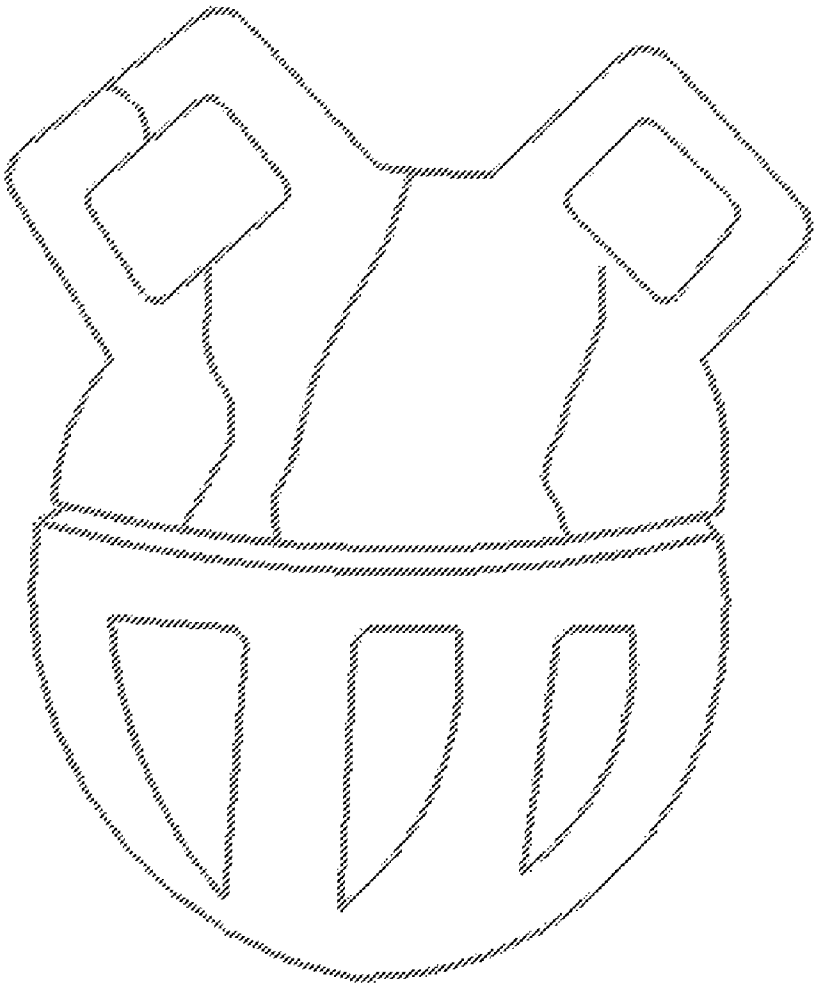
Figure 11C:
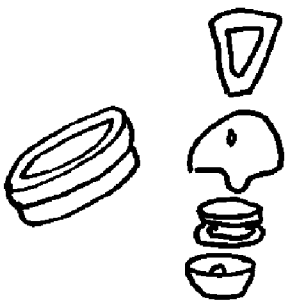
FIGS. 11A to 11C are exploded perspective views of the side of a fifth exemplary embodiment of the exercise device according to the present invention.
Figure 11B:
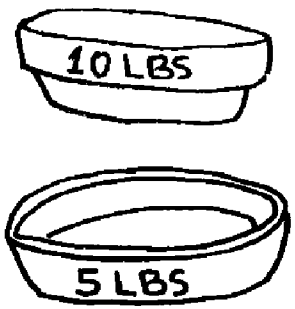
Figure 11A:
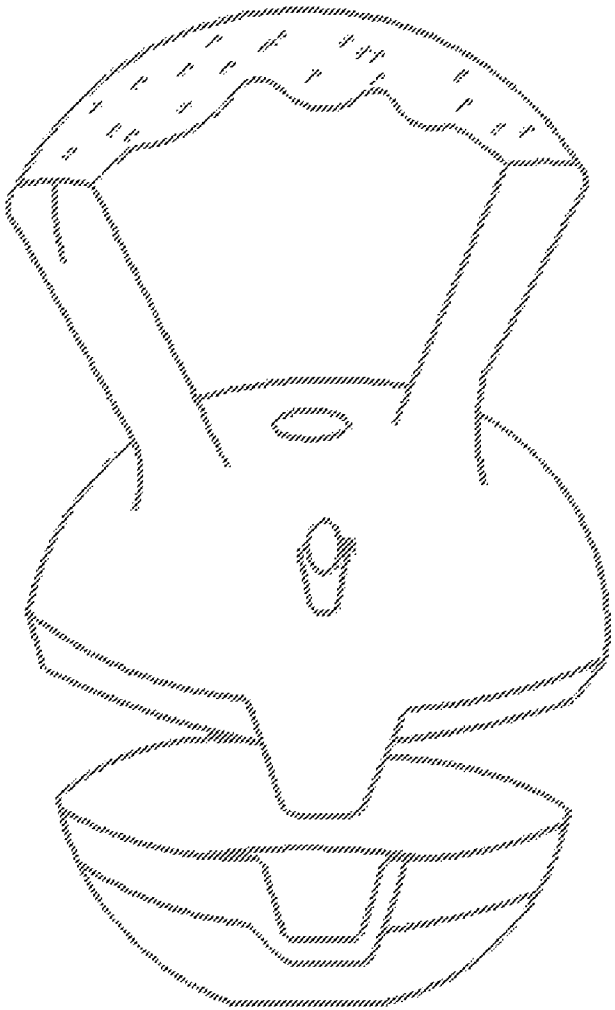
Figure 12B:
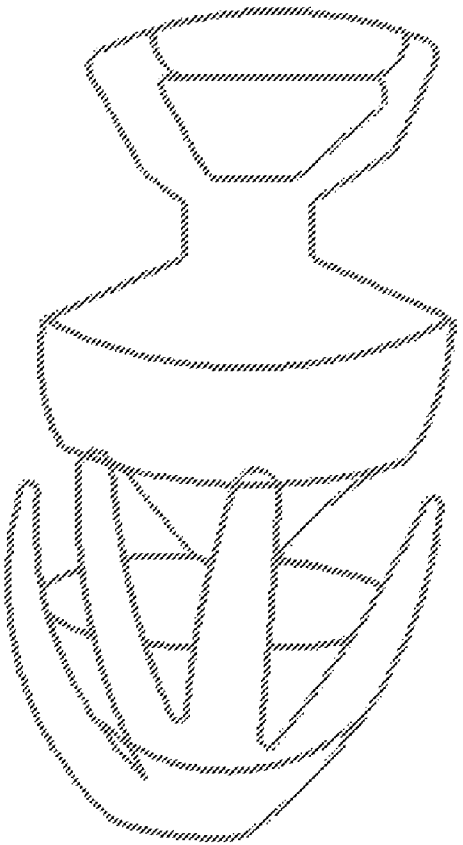
FIG. 12B is an exploded perspective view of the side of a seventh exemplary embodiment of the exercise device according to the present invention.
Figure 12A:
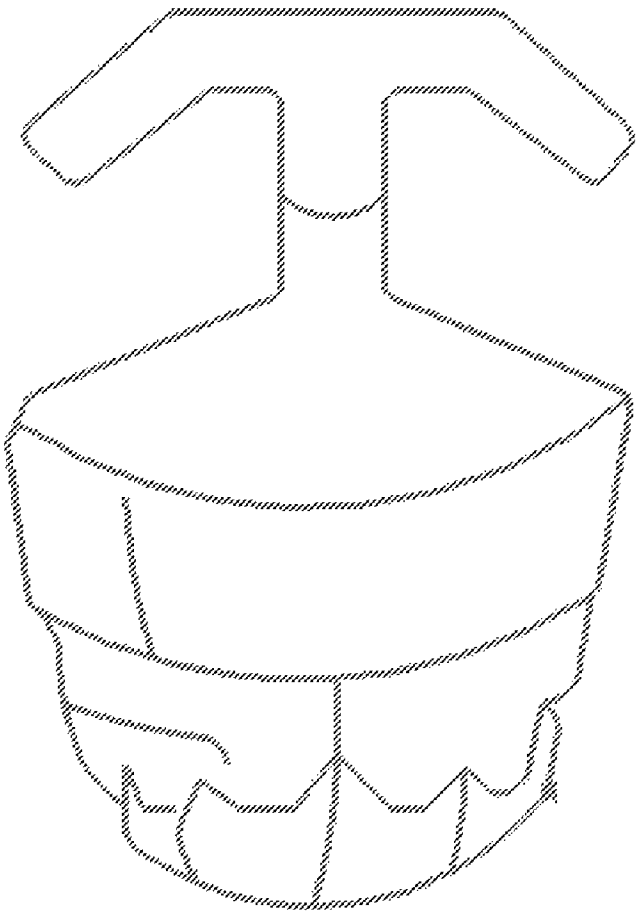
FIG. 12A is an elevational view of the front of a sixth exemplary embodiment of the exercise device according to the present invention.
Figure 13B:
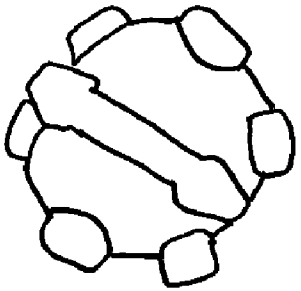
FIG. 13B is a top view plan view of the exercise device of FIG. 13A.
Figure 13C:
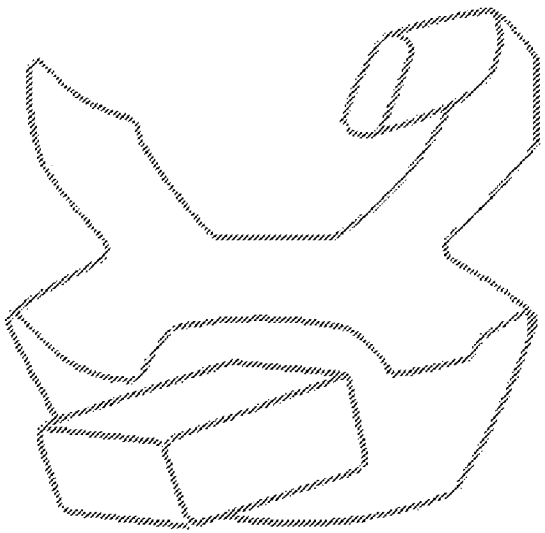
FIG. 13C is a partial perspective view of the side of the exercise device of FIG. 13A.
Figure 13A:
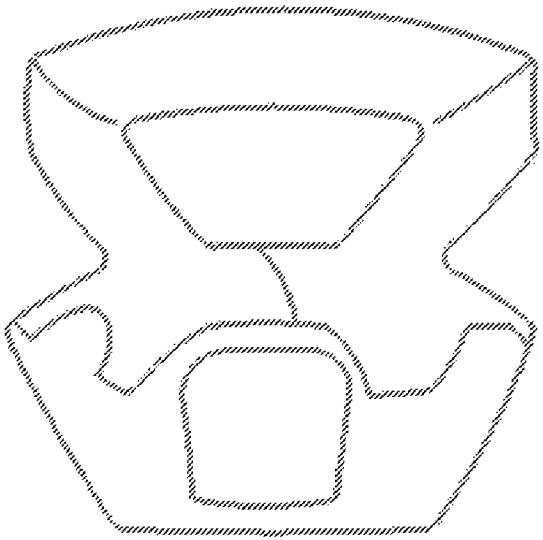
FIG. 13A is an elevational view of the front of an eighth exemplary embodiment of the exercise device according to the present invention.

FIG. 5 is an exploded view of the first embodiment of the device of FIG. 1, which illustrates an exemplary embodiment of the mechanism for assembling the device whereby the modular plate-shaped weights 4, 5 are selectively removable from the body 2 and the base 6 of the device. FIG. 6 shows a cover 9 is attached to the bottom base of the body 2. In the illustrated embodiment of FIG. 6, the cover 9 has a bottom surface with a non-illustrated boss having a series of exterior threads. Additionally, the top surface of each modular weight plate 4, 5 has a depression with a series of interior threads (not illustrated due to the scale of the drawing) that opposingly correspond to the exterior threads of the cover 9 such that the top surface of the adjacent modular weight plate (in FIG. 6, this is plate 4) can be removably attached to the cover 9 of the body 2 by threading the interior threads of the modular weight plate onto the exterior threads of the cover 9. The bottom surface of each modular weight plate 4, 5 has a non-illustrated boss with a series of exterior threads that are identical to the exterior threads of the boss of the cover 9 and, accordingly, also opposingly correspond to the interior threads of the depression in the top surface of each modular weight plate. Thus, where the user desires to add additional weight plates to the device (as shown in the exemplary embodiment of FIGS. 1-6), the interior threads of the top surface of each weight plate threadingly engage the exterior threads of the adjacent boss at the bottom surface of each weight plate. As such, that the weight plates may be removably attached to one another in a vertically oriented stack.

To complete the assembly of the device, the base 6 of the device is connected with the handle 1, the body 2, and the one or more weight plates 4, 5. Accordingly, in the illustrated exemplary embodiment, the base 6 may be similarly removably attached to the bottom surface of each modular weight plate 4, 5. In FIGS. 5 and 6, the base 6 is shown as having a depression with a series of interior threads that opposingly correspond to the exterior threads of the boss at the bottom surface of each weight plate such that the base 6 may be threaded onto and removably attached to the bottom surface of the weight plate that is positioned at the bottom-most position in the weight stack. This "screw-in" design allows the mass of the device to be easily adjusted to maximize the benefits during different exercises and to match the fitness level of the user during those exercises. In this configuration, the modular weight plates 4, 5 can be removably attached between the body 2 and the base 6 of the device in any order. For example, if the modular weight plates 4, 5 are available in incremental weights of 2.5 and 5 pounds respectively, then the device can be altered to change the total weight and resistance load of the device by adding and removing any combination of 2.5 pounds, 5 pounds and 7.5 pounds in this exemplary embodiment. In general, it is contemplated that there can be any number of modular weight plates having any desired amount of weight that is reasonable and safe for use with the device.

The mechanism described above and shown in FIGS. 1-6 for assembling the device 10 serves as just one illustration of a large number of mechanisms that are contemplated by the present invention for attaching the body 2 to the base 6 of the device. As shown in some of the embodiments of the present invention depicted in FIGS. 7 to 30, the body 2 and base 6 may be formed into corresponding, mating shapes whereby the body 2 is directly removably attached to the base 6 whereby the one or more modular weights are completely enclosed inside the device 10, are not visible from the exterior of the device, and are not a part of the mechanism for interconnecting the body 2 with the base 6. In addition, one or more latches or other mechanical methods of attaching and securing the body 2 to the base 6, such as a rotating hinge as shown in FIG. 19, may be utilized. Furthermore, as shown by way of example in FIGS. 16 and 18, the body 2 and/or the base 6 may be specifically molded into a shape that is conducive to a hand grip such that a user may easily disassemble the base 6 from the body 2, or vice versa, using his or her hands. Also, visual indicators may be applied to the body 2 and/or the base 6 to aid and confirm to the user that the body 2 and the base 6 have been properly assembled and attached to one another.

A number of ways for securing the one or more modular weights inside or amongst the body 2 and base 6 of the device, based upon the respective shapes of the weights, body 2 and the base 6 of the device, are also contemplated by the present invention. For example, as shown in FIGS. 13A-13C, 15B, 19A-19B, 21A-21B, and 24A-24B, one or more pockets, slots, or keyed portions may be formed in the exterior surface of the body 2 and/or the base 6 of the device for mateably holding or containing the one or more modular weights.

As shown in detail in FIGS. 4-6, for purposes of being able to rest the device 10 on a surface without fear that the device will not remain stationary while adjusting the one or more modular weights, the bottom portion of the base 6 may be flat. Furthermore, a tactile, traction-like footpad 7 that may be made of rubber or multiple rubber "feet" may also be incorporated on the bottom portion of the base 6 to further aid in preventing the device from moving around when it is placed on a surface and to prevent the device from damaging the surface. This design option allows the device to be used as a support system during exercises such as push-ups or planks thereby allowing the increased benefit of the vibrational overload to be added to these ordinarily mundane exercises. In addition, as shown in FIGS. 5 and 6, the interior of the base 6 may be made to be relatively hollow to reduce the amount of weight that it contributes to the overall total weight of the device and/or to reduce production cost.

With respect to the vibratory capabilities of the device, a vibration unit may be incorporated inside the device 10. In the exemplary embodiment of shown in FIGS. 1-6, the vibration unit is comprised of a battery-powered motor 12 that is incorporated into the hollow interior of the body 2. For example, FIG. 6 shows an exploded view of the motor 12. Attached to a shaft (central axel) (not shown) protruding from either or both ends of the motor 12 are two asymmetrically shaped weights (not shown) designed to cause the entire device to vibrate. The sizes of the attached weights can be varied to change the amplitude of the vibration, as can the size of the motor to accommodate the weights. In one exemplary embodiment, the weights have sufficient mass and displacement to create a displacement of 2-4 mm at a frequency of approximately 28 Hz. Here, in comparison to FIG. 5, two opposing battery access doors 3 are shown as being removed from the body 2 to expose their respective battery compartments 18. Each of the battery compartments 18 may hold one of two exemplary battery packs 11 that are electrically coupled to the vibration motor 12 thereby providing power to the motor 12. Alternatively, a single access door may be used to incorporate the batteries needed in a single compartment. It is desirable that these battery packs 11 are rechargeable and a charging socket may be incorporated into the device in a position opposite the power switch on the body of the device. As described above, the cover 9 is attached to the bottom of the body 2 and can, if desired, form the floor of the one or more battery compartments 18 in the body 2. To secure the vibration motor 12 inside the body 2 of the device, a combination of large mounting pins 13, motor mounting brackets 14, smaller mounting pins 15, and offset weights 16 may be used.

The vibratory movement imparted by the motor 12 may be of any suitable displacement amount and frequency for purposes of improving the metabolic rate of the upper body musculature. For example, with respect to the exemplary embodiment shown in FIGS. 1-6, the motor 12 may be capable of applying a displacement of between 2 and 4 mm at a frequency of between 25 and 35 Hz. To control or to adjust the operation of the vibration motor (e.g., to activate the device between ON and OFF modes, to adjust frequency settings, etc.), one or more switches or buttons may be provided. For example, as shown in FIG. 2, an ON/OFF switch 8 is provided on the handle 1 of the device.

With respect to the handle 1, it is envisioned that the handle may be made in a variety of suitable shapes, thicknesses and sizes that take into account a number of considerations that include, but are not limited to, the type of exercise that should be performed with the device, the particular physical capabilities, grip strength, and endurance of the target user of the device, and the challenges in gripping the device as it vibrates. FIGS. 7-30 depict alternative embodiments of the device having a wide range of possible configurations of the handle, including wherein the handle is comprised of more than one sub-handle where it is desirable that a user uses both hands to grip the device (for example, see FIGS. 10A-10B). In addition, to provide an added gripping surface at the handle, the handle may be shaped in ways or constructed of materials that are well suited for contact with a human hand and/or a tactile, traction-like grip material may be applied to a portion of the exterior surface of the handle (for example, see FIG. 11, 14, 15A, 18, 22, and 29A).

Additionally, gaskets 17 can be provided between any of the components of the device. Illustratively, FIG. 6 depicts three gaskets 17 as separating the components of the device. These gaskets 17 separate the metal parts to lessen the friction felt therebetween when the device is in use thereby decreasing the wear of the adjacent parts.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A handheld, vibratory exercise device, comprising:

an upper portion having:

a handle portion for gripping the device; and a body portion;

a base portion being removably attached to the upper portion;

a vibratory unit positioned within a hollow interior of the upper portion and causing at least one of the upper and base portions to vibrate;

at least one modular weight, the upper and base portions selectively removably holding the at least one modular weight therebetween, and wherein said at least one modular weight has a predetermined modular shape, weight amount and size configured to be selectively, removably and cooperatively held between the upper and base portions outside of the hollow interior of the upper portion; and when so holding the at least one modular weight, the upper portion, the at least one modular weight and the base portion have a low center of mass.

2. The device of claim 1, wherein the handle portion is integral with the body portion.

3. The device of claim 1, wherein the upper and base portions together form a kettle bell.

4. The device of claim 1, wherein the upper and base portions and the at least one modular weight together form a kettle bell.

5. The device of claim 1, wherein the exterior surface of the handle portion is comprised of a material that aids the user's ability to grip the handle portion.

6. The device of claim 1, wherein the handle portion is comprised of two or more subhandles.

7. The device of claim 1, wherein the vibratory unit is battery powered.

8. The device of claim 1, wherein the vibratory unit is capable of vibrating with a displacement of between approximately 2 mm and approximately 4 mm at a frequency of between approximately 25 Hz and approximately 35 Hz.

9. The device of claim 1, wherein the body portion and the base portion form a hollow shell that completely encloses the at least one modular weight.

10. The device of claim 1, wherein the at least one modular weight is a plurality of modular plates shaped to be sandwiched between the upper and base portions.

11. The device of claim 1, further comprising at least one threaded engagement that removably attaches the base portion to the upper portion and removably holds the at least one modular weight between the upper and base portions.

12. A handheld, vibratory exercise device, comprising:

an upper portion having:

a handle portion for gripping the device; and a body portion;

a base portion being removably attached to the upper portion;

a vibratory unit positioned within a hollow interior of the upper portion and causing at least one of the upper and base portions to vibrate; and a plurality of selectively removable and modular weights, the upper and base portions removably holding therebetween the plurality of selectively removable modular weights in a serial vertical stack, and wherein each of said plurality of modular weights has a predetermined modular shape, weight amount and size configured to be selectively, removably and cooperatively held in the serial vertical stack between the upper and base portions outside of the hollow interior of the upper portion, the handle and base portions and the plurality of selectively removable modular weights having a pendulum-type ball exterior shape with a low center of mass.

13. The device of claim 12, wherein the device is a kettle bell.

14. The device of claim 12, wherein the vibratory unit is battery powered.

15. The device of claim 12, wherein the vibratory unit is capable of vibrating with a displacement of between approximately 2 mm and approximately 4 mm at a frequency of between approximately 25 Hz and approximately 35 Hz.

16. The device of claim 12, wherein: each weight of the plurality of weights has a top surface defining an interior threaded recess and a bottom surface having an exterior threaded boss.

17. The device of claim 16, wherein:

the upper portion further comprises a bottom surface having an exterior threaded upper boss that opposingly corresponds to the interior threaded recess of the top surface of each of the plurality of selectively removable modular weights such that the upper portion threadingly engages the top surface of the adjacent weight plate in the vertical stack; and the base portion further comprises a top surface defining an interior threaded base recess that opposingly corresponds to the exterior threaded boss of the bottom surface of each of the plurality of selectively removable modular weights such that the base portion threadingly engages the bottom surface of the adjacent weight plate in the vertical stack.

18. A handheld, vibratory exercise device, comprising:

an upper portion having:

a handle portion for gripping the device; and a body portion;

a base portion being removably attached to the upper portion, the upper and base portions cooperatively holding therebetween at least one selectively removable and modular weight; and a vibratory unit positioned within a hollow interior of the upper portion and causing at least one of the upper and base portions to vibrate, the upper and base portions together with the vibratory unit having a low center of mass, and wherein said at least one selectively removable and modular weight has a predetermined modular shape, weight amount and size configured to be selectively, removably and cooperatively held between the upper and base portions outside of the hollow interior of the upper portion.

19. The device of claim 18, wherein the vibratory unit is capable of vibrating with a displacement of between approximately 2 mm and approximately 4 mm at a frequency of between approximately 25 Hz and approximately 35 Hz.

* * * * *